US011435700B2

(12) United States Patent
Hirayama

(10) Patent No.: US 11,435,700 B2
(45) Date of Patent: Sep. 6, 2022

(54) SWITCH DEVICE AND TIMEPIECE

(71) Applicant: CASIO COMPUTER CO., LTD., Tokyo (JP)

(72) Inventor: Sen Hirayama, Urayasu (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 17/141,492

(22) Filed: Jan. 5, 2021

(65) Prior Publication Data

US 2021/0232096 A1 Jul. 29, 2021

(30) Foreign Application Priority Data

Jan. 24, 2020 (JP) ..... JP2020-009926

(51) Int. Cl.
*G04B 37/10* (2006.01)

(52) U.S. Cl.
CPC ..... *G04B 37/106* (2013.01)

(58) Field of Classification Search
CPC .... G04B 37/081; G04B 37/106; H01H 13/06; H01H 13/14; H01H 2221/08; H01H 2300/016; H01H 2223/002
USPC ..... 368/290
See application file for complete search history.

(56) References Cited

U.S. PATENT DOCUMENTS 7,816,618 B2 * 10/2010 Uchii ..... H01H 33/56 218/51
8,585,282 B2 * 11/2013 Shindo ..... G04B 43/002 368/286
8,608,372 B2 * 12/2013 Koshoji ..... G04G 21/00 368/308
10,627,781 B2 * 4/2020 Ichimura ..... G04B 37/08
2008/0197578 A1 * 8/2008 Osborne ..... F16J 15/3236 277/590

FOREIGN PATENT DOCUMENTS

| | | | | |
|---|---|---|---|---|
| CN | 200958783 Y | * | 10/2007 | |
| CN | 105467814 A | * | 4/2016 | ..... G04B 37/106 |
| JP | S59149082 U | | 10/1984 | |
| JP | H1192748 A | | 4/1999 | |
| JP | H11109057 A | | 4/1999 | |
| JP | 2002054747 A | | 2/2002 | |
| JP | 2007256067 A | | 10/2007 | |

OTHER PUBLICATIONS

Japanese Office Action (and English language translation thereof) dated Dec. 10, 2021, issued in counterpart Japanese Application No. 2020-009926.
Chinese Office Action (and English language translation thereof) dated Jan. 5, 2022, issued in counterpart Chinese Application No. 202110072648.

* cited by examiner

*Primary Examiner* — Edwin A. Leon
(74) *Attorney, Agent, or Firm* — Holtz, Holtz & Volek PC

(57) ABSTRACT

A switch device including: a case provided with a through hole; an operating member having a shaft portion slidably inserted into the through hole; and a plurality of gaskets which are provided on an outer periphery of the shaft portion and are in slidable contact with an inner surface of the through hole, at least one gasket among the plurality of gasket being made of a material containing fluorine.

9 Claims, 15 Drawing Sheets

SWITCH DEVICE AND TIMEPIECE

BACKGROUND

Technical Field

The technical field relates to a switch device used in electronic devices such as a wristwatch and a mobile communication device, and a timepiece including the same.

Description of the Related Art

For example, there is known a switch device of a wristwatch having a structure in which three waterproof gaskets are provided in a shaft portion of an operating member slidably inserted into a through hole of a case as described in JP 2007-256067 A.

SUMMARY

One of aspects is a switch device including: a case provided with a through hole; an operating member having a shaft portion slidably inserted into the through hole; and a plurality of gaskets which are provided on an outer periphery of the shaft portion and are in slidable contact with an inner surface of the through hole, at least one gasket among the plurality of gasket being made of a material containing fluorine.

DESCRIPTION OF THE EMBODIMENT

Hereinafter, an embodiment applied to a wristwatch will be described with reference to FIGS. 1 to 15.

Figure 1:
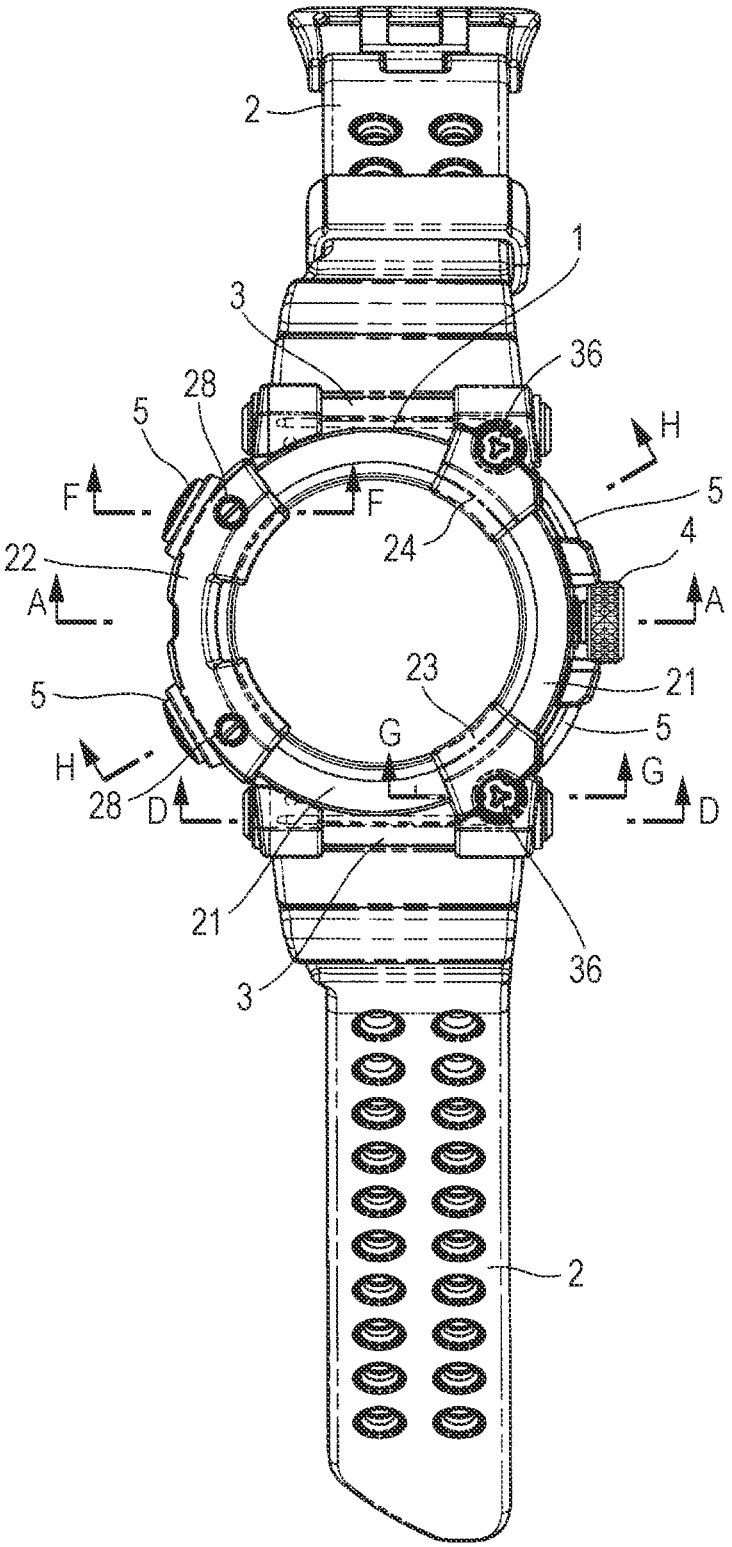
FIG. 1 is a front view illustrating an embodiment applied to a wristwatch.
Figure 2:
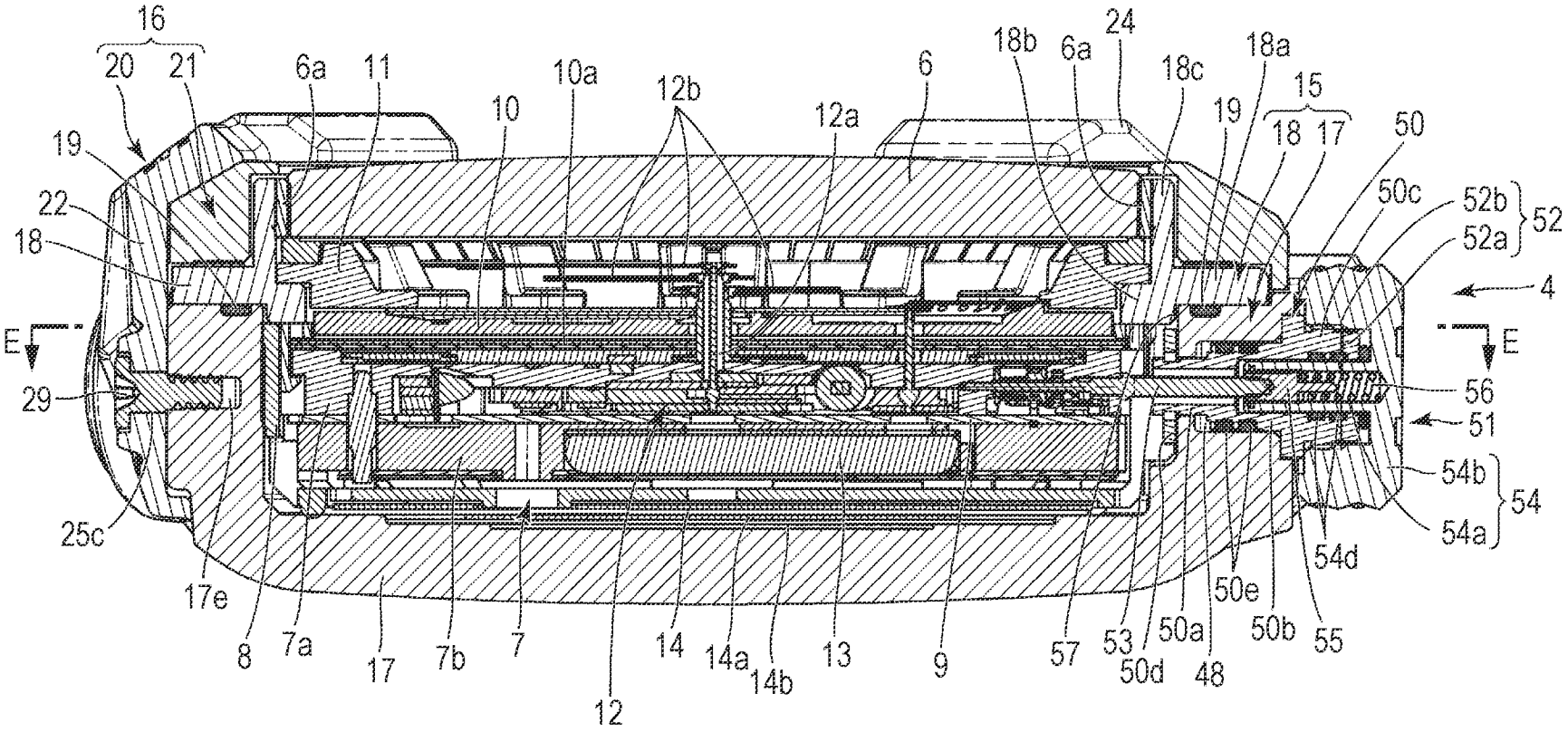
FIG. 2 is an enlarged cross-sectional view of the wristwatch illustrated in FIG. 1 in an A-A arrow view.

This wristwatch includes a wristwatch case 1 as illustrated in FIGS. 1 and 2. A band attachment portion 3 to which a watch band 2 is attached is provided on the 12 o'clock side and the 6 o'clock side of the wristwatch case 1. In addition, a switch device 4 is provided on the 3 o'clock side of the wristwatch case 1, and pushbutton switches 5, which are switch devices, are provided on the 2 o'clock side, the 4 o'clock side, the 8 o'clock side, and the 10 o'clock side of the wristwatch case 1, respectively.

In addition, a watch glass 6 is provided in an upper opening portion of the wristwatch case 1 via a gasket 6*a* as illustrated in FIGS. 1 and 2. Inside the wristwatch case 1, a watch module 7 is provided via a middle frame 8. The watch module 7 includes an upper housing 7*a* and a lower housing 7*b*. A circuit board 9 is provided between an upper housing 7*a* and a lower housing 7*b*.

As illustrated in FIG. 2, a dial 10 and a parting member 11 are provided on in upper portion of the upper housing 7*a*. The dial 10 is formed in a substantially disk shape using a light-transmitting material and a solar panel 10*a* is provided on a lower surface of the dial 10. The parting member 11 is formed in a ring shape, and hour characters 11*a* are provided on an inner peripheral surface at equal intervals. The parting member 11 is attached to the inner peripheral surface of the wristwatch case 1 in the state of being arranged on an outer peripheral portion on an upper surface of the dial 10.

In addition, a plurality of watch movements 12 are provided in the upper housing 7*a*, and a battery 13 is provided in the lower housing 7*b*, as illustrated in FIG. 2. Each of these watch movements 12 has a pointer shaft 12*a* that protrudes upwards on the dial 10 and the solar panel 10*a*, and is configured to move a pointer 12*b* provided at an upper end of the pointer shaft 12*a* above the dial 10 to indicate and display information such as the time.

Meanwhile, the wristwatch case 1 includes a case body 15 and an exterior member 16 as illustrated in FIGS. 1 to 4. The case body 15 includes a lower case 17 (first member) and an upper case 18 (second member). The lower case 17 has a tubular side wall and a bottom, and these are integrally formed using a highly rigid synthetic resin such as reinforced plastic and a synthetic resin mixed with a carbon fiber or a glass fiber. In this case, attachment protruding portions 17*a* of the band attachment portion 3 are provided so as to protrude from the side wall of the lower case 17 on the 12 o'clock side and the 6 o'clock side.

Figure 3:
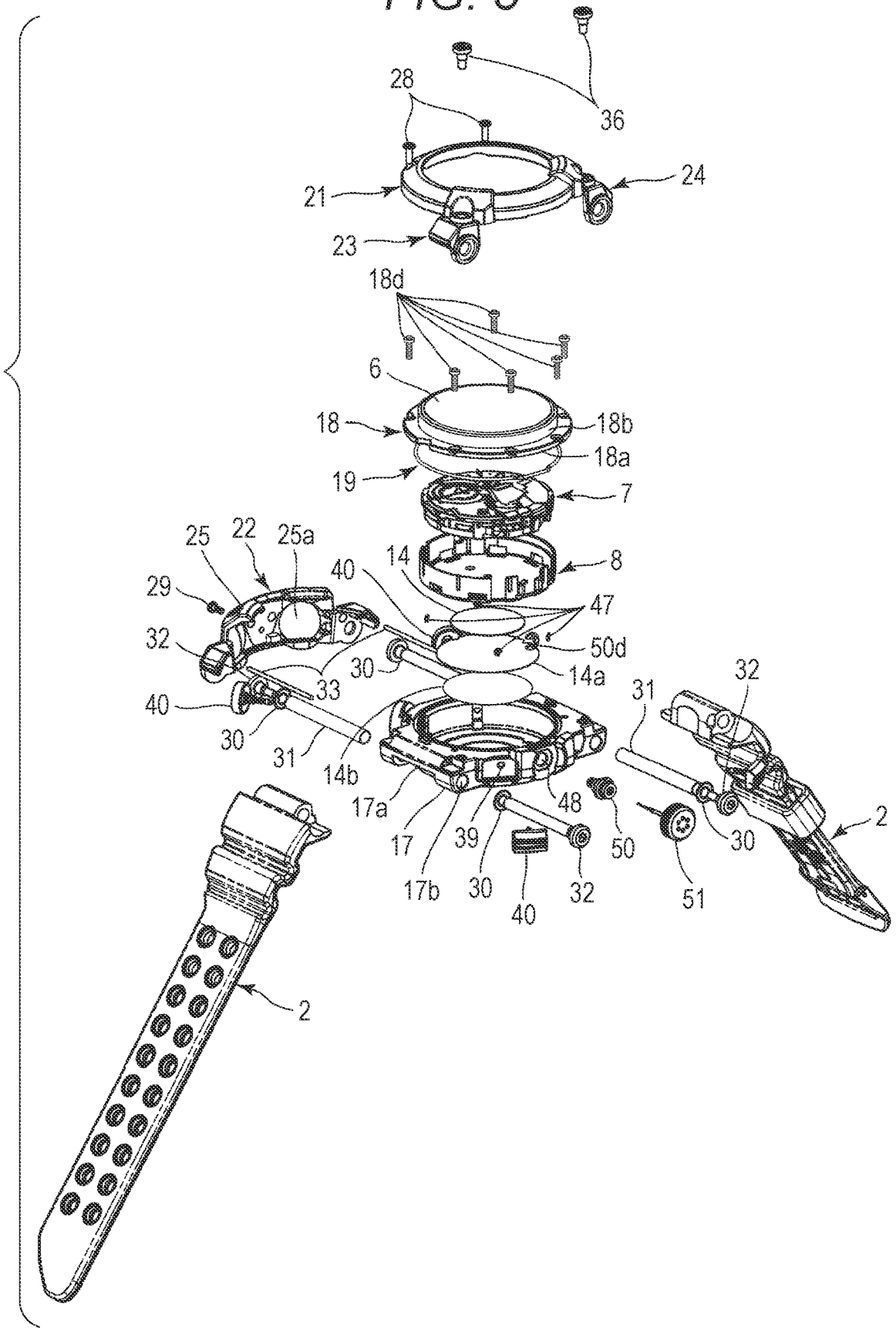
FIG. 3 is an exploded perspective view of the wristwatch illustrated in FIG. 1.

As illustrated in FIGS. 2 and 3, a piezoelectric element 14 is provided at the bottom in the lower case 17. That is, the piezoelectric element 14 is provided on a vibrating plate 14*a*, and the vibrating plate 14*a* is pasted to the bottom in the lower case 17 by a double-sided adhesive tape 14*b*. The watch module 7 is arranged in the lower case 17 via the middle frame 8. The upper case 18 is formed in a substantially ring shape using a material having higher rigidity than the lower case 17, for example, metal such as stainless steel.

That is, the upper case 18 is provided with a first ring portion 18*a* arranged on an upper end surface of the tubular side wall of the lower case 17, a second ring portion 18*b* that abuts on an inner peripheral surface of the lower case 17, and a tubular portion 18*c* provided on the first ring portion 18*a* and to which the watch glass 6 is attached via the gasket 6*a* as illustrated in FIGS. 2 to 5. In this case, the upper case 18 is attached to an upper portion of the lower case 17 by a plurality of screws 18*d* via a waterproof ring 19 between the first ring portion 18*a* and the upper end surface of the lower case 17.

As illustrated in FIGS. 1 to 8, the exterior member 16 includes a first exterior member 20 and a second exterior member 21. The second exterior member 21 is arranged on the upper case 18 so as to cover an upper surface of the first ring portion 18*a* of the upper case 18 and an outer peripheral surface of the tubular portion 18*c*, and is formed in a substantially ring shape using decorative metal such as a titanium alloy and an aluminum alloy. The first exterior member 20 is arranged from an upper surface of the second exterior member 21 to an outer periphery of the case body 15, and is divided into a plurality of parts along the outer periphery the case body 15.

That is, as illustrated in FIGS. 1 to 8, the first exterior member 20 includes: a first exterior piece 22 arranged on almost half of one side from the 12 o'clock side to the 6 o'clock side through the 9 o'clock side on the outer periphery of the case body 15; a second exterior piece 23 arranged so as to oppose the first exterior piece 22 at the band attachment portion 3 on the 6 o'clock side; and a third exterior piece 24 arranged so as to oppose the first exterior piece 22 at the band attachment portion 3 on the 12 o'clock side. Each of the first to third exterior pieces 22 to 24 is made of a soft synthetic resin such as a urethane resin.

Figure 4:
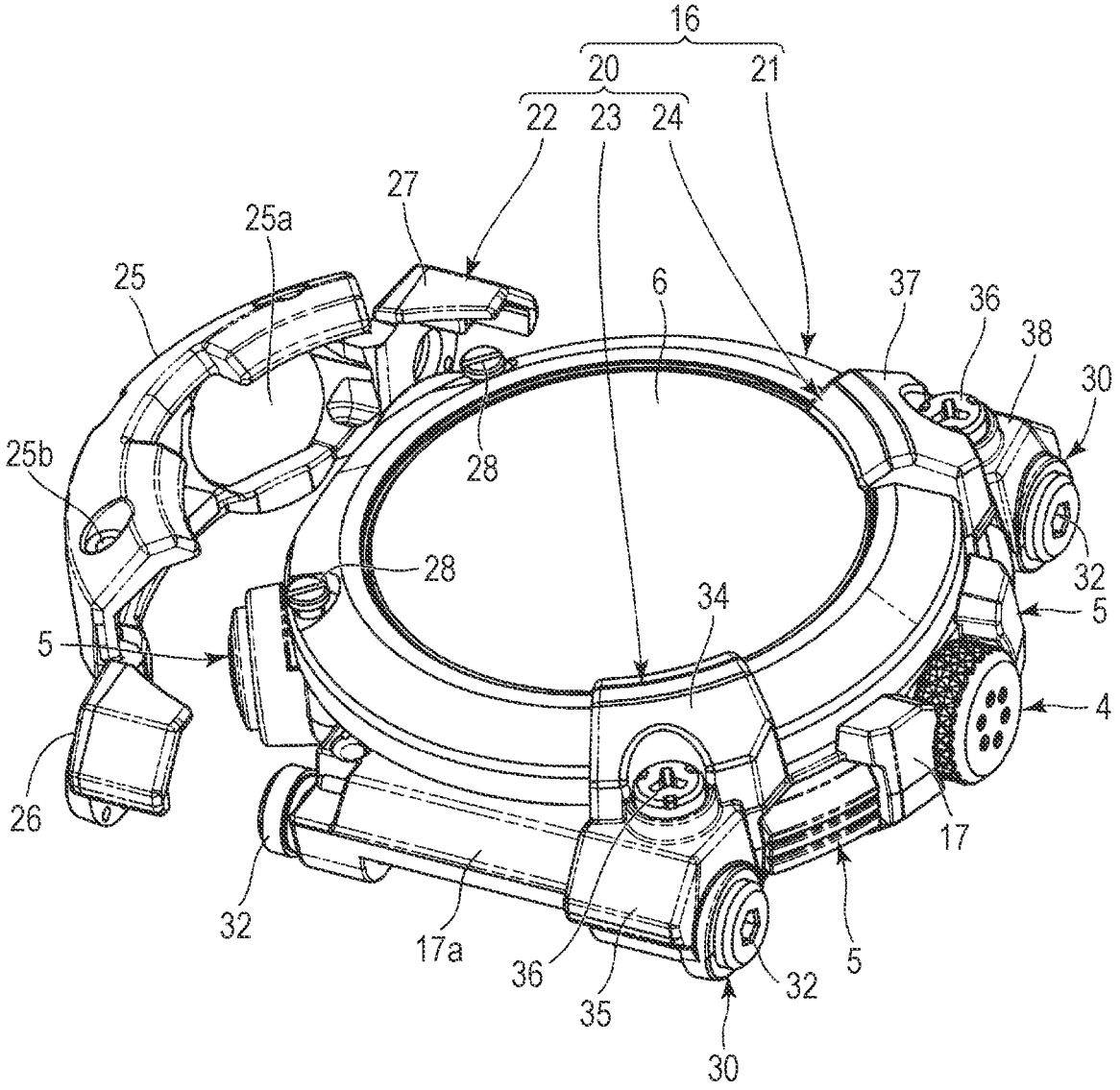
FIG. 4 is an enlarged perspective view illustrating a state where a first exterior piece of a first exterior member is disassembled in the wristwatch illustrated in FIG. 1.
Figure 5:
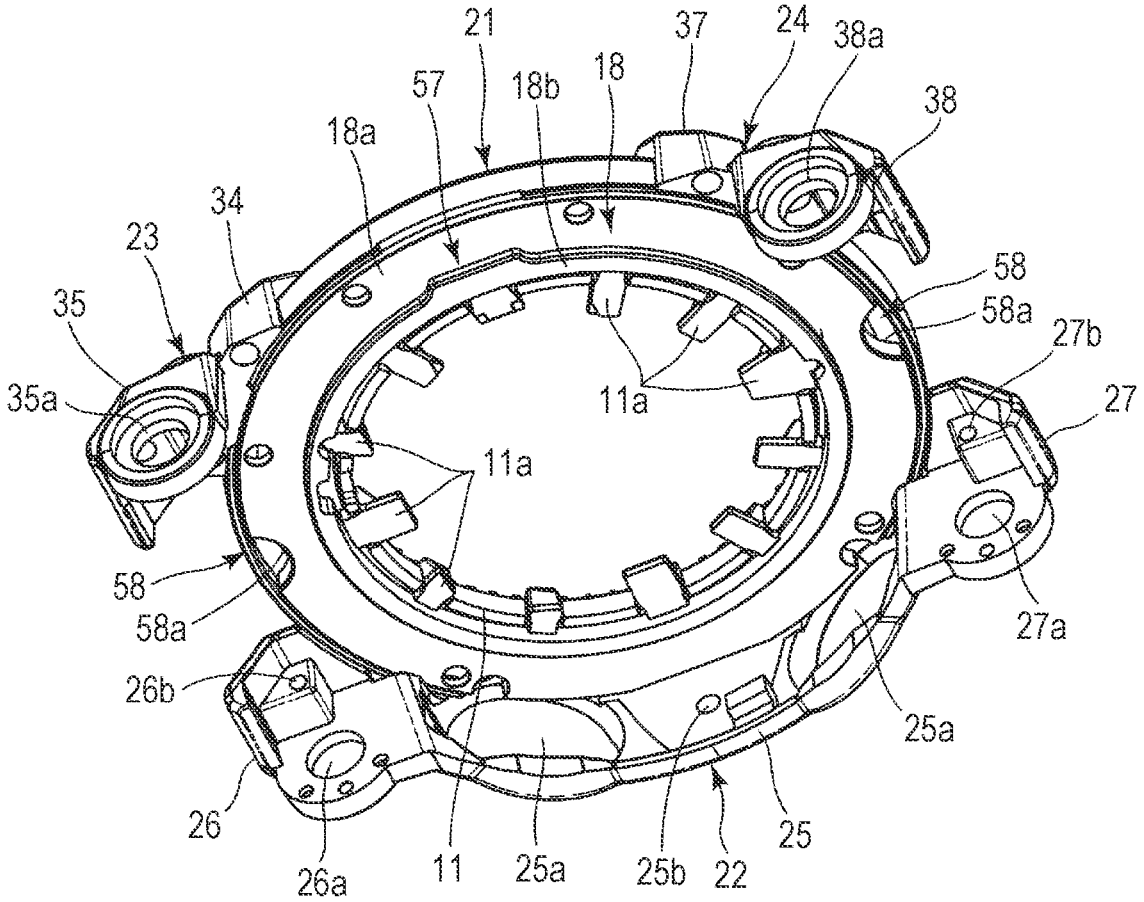
FIG. 5 is an enlarged perspective view as viewed from a lower surface side in a state where a second exterior member to which second and third exterior pieces of the first exterior member are attached is attached to an upper case portion in the wristwatch illustrated in FIG. 4.

As illustrated in FIGS. 3 to 5, the first exterior piece 22 includes: an exterior body portion 25 corresponding to a portion of the case body 15 from the 8 o'clock side to the 10 o'clock side; a first cover portion 26 corresponding to the 7 o'clock side of the case body 15; and a second cover portion 27 corresponding to the 11 o'clock side of the case body 15. Both side portions of the exterior body portion 25 are arranged from an inner peripheral edge of the second exterior member 21 to a lower portion of the side wall of the lower case 17 through the upper surface of the second exterior member 21 and a side surface of the upper case 18.

As illustrated in FIGS. 3 to 5, button insertion holes 25*a* into which a head portion 43 of the pushbutton switch 5 is inserted are provided in the exterior body portion 25 so as to correspond to the 8 o'clock side and the 10 o'clock side of the case body 15, respectively. In addition, a first screw insertion hole 25*b* into which a first screw 28 is inserted is provided in an upper portion of the exterior body portion 25 so as to correspond to the 8 o'clock side and the 10 o'clock side, respectively, as illustrated in FIGS. 4 and 12A.

Figure 12A:
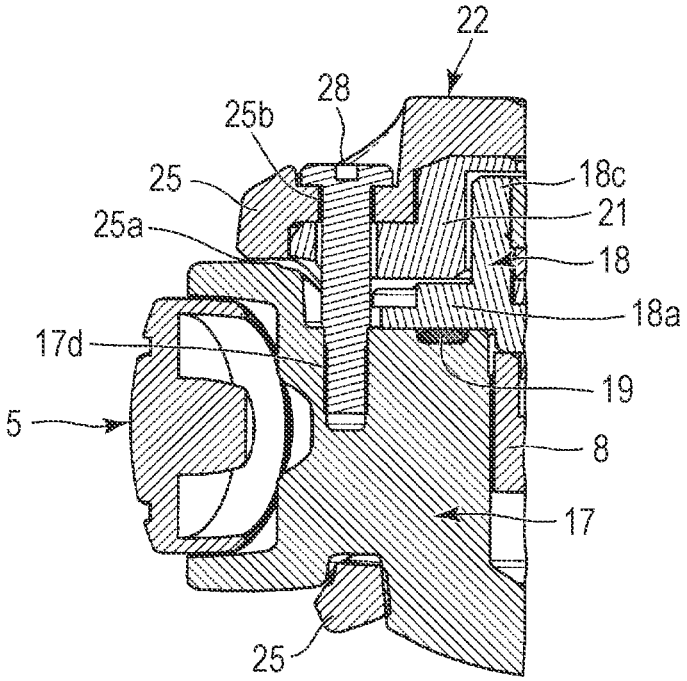
FIG. 12A is an enlarged cross-sectional view in an F-F arrow view of a cross section of the main part of the wristwatch illustrated in FIG. 1.
Figure 12B:
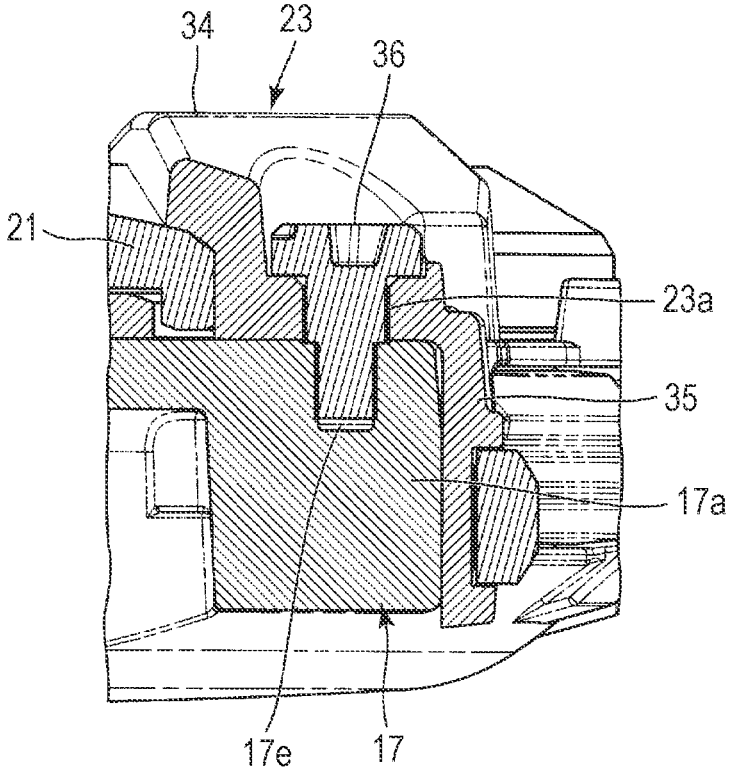
FIG. 12B is an enlarged cross-sectional view in a G-G arrow view of the cross section of the main part of the wristwatch illustrated in FIG. 1.

In this case, as illustrated in FIGS. 1, 4, and 12A, the first screw 28 passes through the first screw insertion hole 25*b* of the exterior body portion 25 and holes of the second exterior member 21 and the first ring portion 18*a* of the upper case 18 to be screwed into a first screw hole 17*d* provided at an upper end of the side wall of the lower case 17, thereby attaching the exterior body portion 25 and the second exterior member 21 to the lower case 17 together with the upper case 18.

Further, as illustrated in FIGS. 2 and 3, the side portion of the exterior body portion 25 is provided with a second screw insertion hole 25*c* into which a second screw 29 is inserted is provided so as to correspond to a side surface of the case body 15 on the 9 o'clock side. The second screw 29 is screwed into a second screw hole 17*e* provided on a side surface of the side wall of the lower case 17 from the second screw insertion hole 25*c* of the exterior body portion 25, thereby attaching the exterior body portion 25 to the side surface of the lower case 17.

As illustrated in FIGS. 3 to 5, the first cover portion 26 of the first exterior piece 22 is arranged so as to cover the end of the case body 15 on the 7 o'clock side of the band attachment portion 3 on the 6 o'clock side of the wristwatch case 1. As illustrated in FIG. 5, the first cover portion 26 is provided with a first screw mounting hole 26*a* and a first connecting hole 26*b*.

Figure 10:
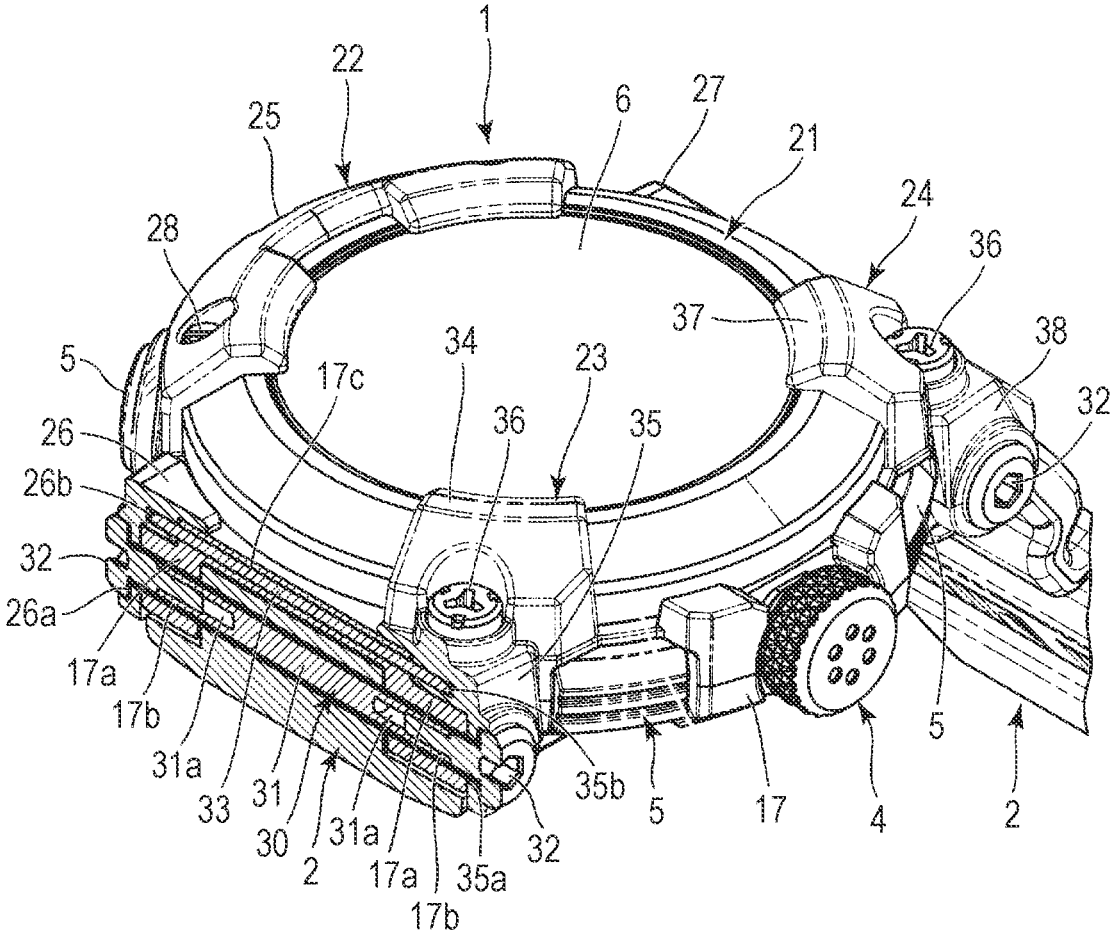
FIG. 10 is an enlarged perspective view of the wristwatch illustrated in FIG. 1 broken in a D-D arrow view.

In this case, as illustrated in FIG. 10, the attachment protruding portion 17*a* on the 6 o'clock side of the lower case 17 is provided with a body insertion hole 17*b* corresponding to the first screw mounting hole 26*a* of the first cover portion 26 on the same axis so as to penetrate from the 7 o'clock side to the 5 o'clock side along the outer periphery of the lower case 17, that is, in the tangential direction with respect to the outer periphery of the lower case 17. A screw body 31 of the mounting screw member 30 is inserted into the body insertion hole 17*b*. The mounting screw member 30 includes the screw body 31 provided with female screw portions 31*a* at both ends and two male screws 32 which are screwed into the respective female screw portions 31*a* of the screw body 31.

As a result, the first cover portion 26 is attached to the attachment protruding portion 17*a* of the lower case 17 as the first screw mounting hole 26*a* corresponds to the body insertion hole 17*b* of the attachment protruding portion 17*a* on the same axis and the male screw 32 is screwed into the female screw portion 31*a* of the screw body 31 through the first screw mounting hole 26*a* in a state where the screw body 31 of the mounting screw member 30 is inserted into the body insertion hole 17*b* of the attachment protruding portion 17*a* of the lower case 17 as illustrated in FIG. 10.

Figure 11:
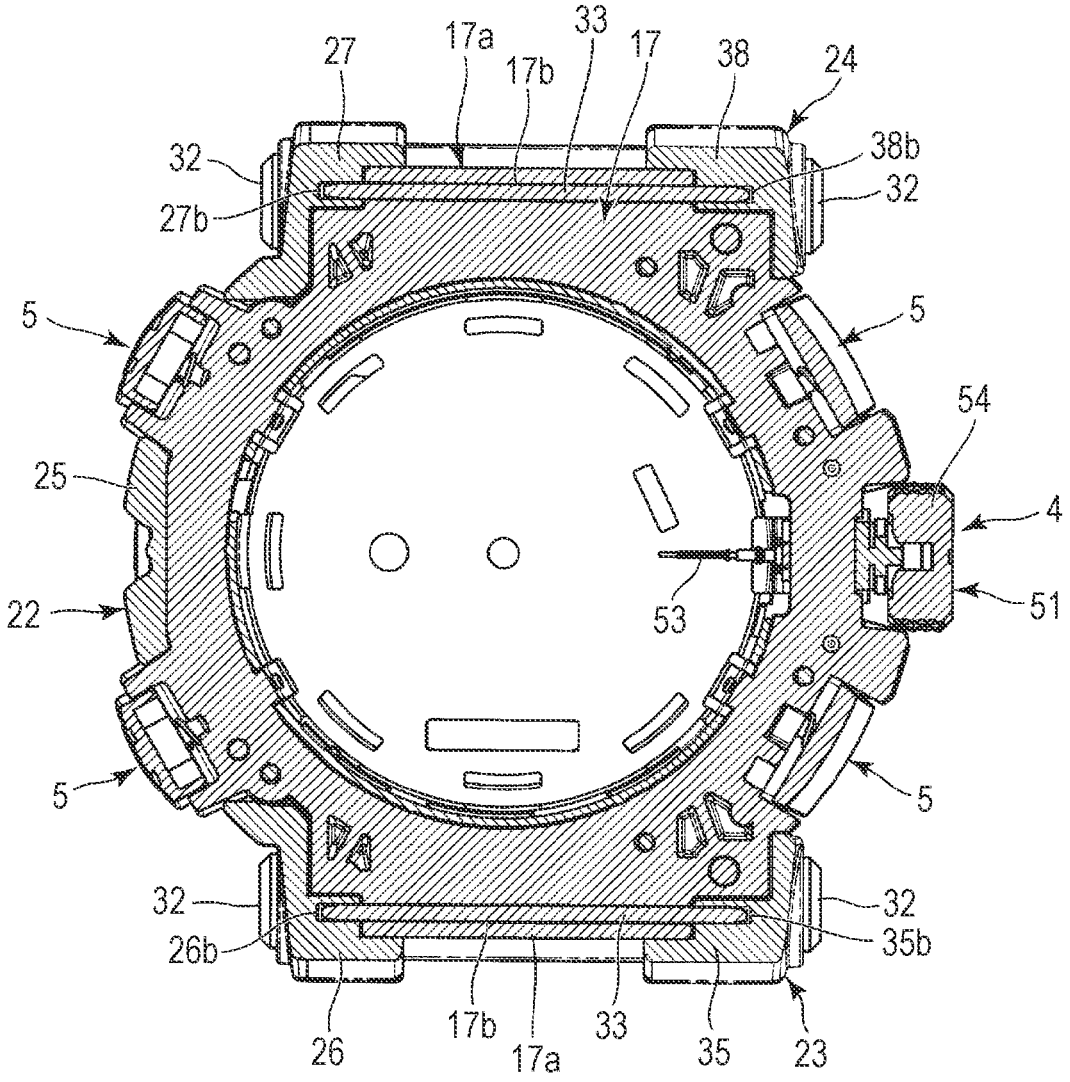
FIG. 11 is an enlarged cross-sectional view of the wristwatch illustrated in FIG. 2 in an E-E arrow view.

In addition, as illustrated in FIGS. 10 and 11, the attachment protruding portion 17*a* on the 6 o'clock side of the lower case 17 is provided with a body connecting hole 17*c* corresponding to the first connecting hole 26*b* of the first cover portion 26 on the same axis so as to penetrate from the 7 o'clock side to the 5 o'clock side along the outer periphery of the lower case 17, that is, in the tangential direction with respect to the outer periphery of the lower case 17. A pin member 33, which is a rod-shaped member, is inserted into the body connecting hole 17*c*. The pin member 33 is formed to have an axial length longer than an axial length of the body connecting hole 17*c* of the attachment protruding portion 17*a*, and protrudes on both sides of the attachment protruding portion 17*a* at the time of being inserted into the body connecting hole 17*c*.

As a result, the first cover portion 26 is connected and fixed to the end of the attachment protruding portion 17*a* so as to prevent the detachment from the attachment protruding portion 17*a* as the pin member 33 is inserted into the body connecting hole 17*c* of the attachment protruding portion 17*a* to protrude from both the sides of the attachment protruding portion 17*a* and this protruding pin member 33 is inserted to correspond to the first connecting hole 26*b* as illustrated in FIGS. 10 and 11.

As illustrated in FIGS. 3 to 5, the second cover portion 27 of the first exterior piece 22 is arranged so as to cover the end of the case body 15 on the 11 o'clock side of the band attachment portion 3 on the 12 o'clock side of the wristwatch case 1. As illustrated in FIGS. 10 and 11, the second cover portion 27 is provided with a second screw mounting hole 27*a* and a second connecting hole 27*b*.

The second cover portion 27 is configured such that the second screw mounting hole 27*a* corresponds to the body insertion hole 17*b* provided in the attachment protruding portion 17*a* of the lower case 17 along the outer periphery of the lower case 17, that is, in the tangential direction with respect to the outer periphery of the lower case 17 on the same axis, which is similar to the first cover portion 26. As a result, the second cover portion 27 is attached to the attachment protruding portion 17*a* of the lower case 17 as the male screw 32 is screwed into the female screw portion 31*a* of the screw body 31 inserted into the body insertion hole 17*b* of the lower case 17 through the second screw mounting hole 27*a*.

In addition, the second cover portion 27 is configured such that the second connecting hole 27*b* corresponds to the body connecting hole 17*c* provided in the attachment protruding portion 17*a* along the outer periphery of the lower case 17, that is, in the tangential direction with respect to the outer periphery of the lower case 17 on the same axis, which is similar to the first cover portion 26. As a result, the second cover portion 27 is connected and fixed to the end of the attachment protruding portion 17*a* so as to prevent the detachment from the attachment protruding portion 17*a* as the pin member 33, which are inserted into the body connecting hole 17*c* of the attachment protruding portion 17*a* and protrude from both the sides of the attachment protruding portion 17*a*, is inserted into the second connecting hole 27*b*.

Meanwhile, the second exterior piece 23 of the exterior member 16 is attached to a portion of the case body 15 on the 5 o'clock side as illustrated in FIGS. 4 to 9B. The second exterior piece 23 includes a second body portion 34 arranged from an inner peripheral edge of the substantially ring-shaped second exterior member 21 to an outer peripheral surface of the upper case 18 through the upper surface of the second exterior member 21, and a third cover portion 35 arranged at an end of the case body 15 on the 5 o'clock side in the band attachment portion 3 on the 6 o'clock side of the wristwatch case 1.

As illustrated in FIGS. 6 to 9B, the second exterior piece 23 is temporarily fixed as the second body portion 34 is attached to the substantially ring-shaped second exterior member 21. In this case, a pair of bit grooves 21*a* bit from the inner peripheral side toward the outer peripheral side and a locking groove 21*b* provided on an outer peripheral portion are provided at a portion of the second exterior member 21 to which the second body portion 34 is attached. The second body portion 34 is provided with a pair of attachment protrusions 34*a* which are inserted and attached into the pair of bit grooves 21*a* of the second exterior member 21, and an engaging protrusion 34*b* that engages with the locking groove 21*b* of the second exterior member 21.

As a result, the second exterior piece 23 is attached and temporarily fixed to the second exterior member 21 as the pair of attachment protrusions 34*a* of the second body portion 34 are inserted into the pair of bit grooves 21*a* of the second exterior member 21 and the engaging protrusion 34*b* of the second body portion 34 engages with the locking groove 21*b* of the second exterior member 21 when being arranged from the inner peripheral edge of the substantially ring-shaped second exterior member 21 to the outer peripheral surface of the upper case 18 through the upper surface of the second exterior member 21 as illustrated in FIGS. 6 to 9B.

In addition, as illustrated in FIGS. 4 to 9B, the third cover portion 35 of the second exterior piece 23 is arranged so as to cover a side portion on the 5 o'clock side of the attachment protruding portion 17*a* of the lower case 17 corresponding to the band attachment portion 3 on the 6 o'clock side of the wristwatch case 1 and opposes the first cover portion 26 of the first exterior piece 22. As illustrated in FIGS. 10 and 11, the third cover portion 35 is provided with a third screw mounting hole 35*a* and a third connecting hole 35*b*.

The third cover portion 35 is configured such that the third screw mounting hole 35*a* corresponds to the body insertion hole 17*b* provided in the attachment protruding portion 17*a* of the lower case 17 along the outer periphery of the lower case 17, that is, in the tangential direction with respect to the outer periphery of the lower case 17 on the same axis as illustrated in FIGS. 10 and 11. In addition, the third cover portion 35 is attached to the attachment protruding portion 17*a* of the lower case 17 as the male screw 32 is screwed into the female screw portion 31*a* of the screw body 31 inserted into the body insertion hole 17*b* of the lower case 17 through the third screw mounting hole 35*a*.

In addition, the third cover portion 35 is configured such that the third connecting hole 35*b* corresponds to the body connecting hole 17*c* provided in the attachment protruding portion 17*a* along the outer periphery of the lower case 17, that is, in the tangential direction with respect to the outer periphery of the lower case 17 on the same axis as illustrated in FIGS. 10 and 11. As a result, the third cover portion 35 is connected and fixed to the end of the attachment protruding portion 17*a* so as to prevent the detachment from the attachment protruding portion 17*a* as the pin member 33, which are inserted into the body connecting hole 17*c* of the attachment protruding portion 17*a* and protrude from both the sides of the attachment protruding portion 17*a*, is inserted to correspond to the third connecting hole 35*b*.

Further, a third screw insertion hole 23*a* into which a third screw 36 is inserted is provided at a boundary between the second body portion 34 and the third cover portion 35 on the second exterior piece 23 as illustrated in FIGS. 5 to 7 and 12B. As a result, the second exterior piece 23 is attached to an upper end of the lower case 17 on the 5 o'clock side as the third screw 36 is inserted into the third screw insertion hole 23*a* from above and screwed into the third screw hole 17*e* provided at the upper end of the lower case 17 on the 5 o'clock side.

Meanwhile, the third exterior piece 24 of the exterior member 16 is attached to a portion of the case body 15 on the 1 o'clock side as illustrated in FIGS. 4 to 8. The third exterior piece 24 includes a third body portion 37 arranged from an inner peripheral edge of the substantially ring-shaped second exterior member 21 to an outer peripheral surface of the upper case 18 through the upper surface of the second exterior member 21, and a fourth cover portion 38 arranged at an end of the case body 15 on the 1 o'clock side in the band attachment portion 3 on the 12 o'clock side of the wristwatch case 1, which is similar to the second exterior piece 23.

Figure 6:
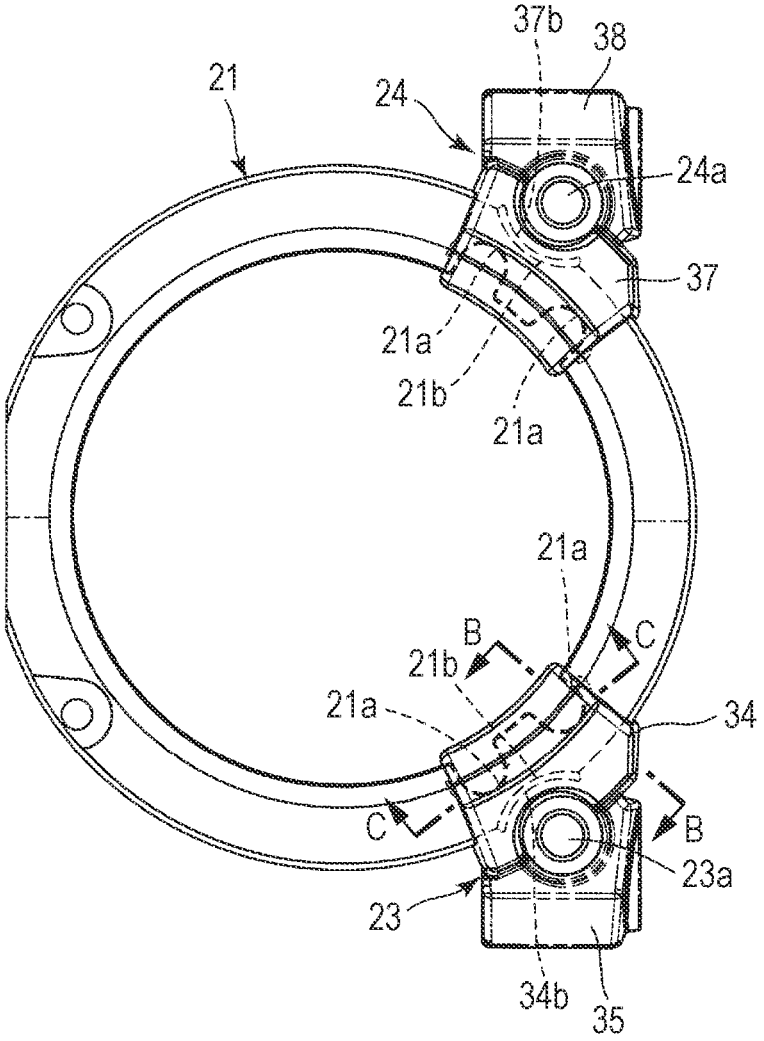
FIG. 6 is an enlarged plan view illustrating a state where the second and third exterior pieces of the first exterior member are attached to the second exterior member illustrated in FIG. 5.
Figure 7:
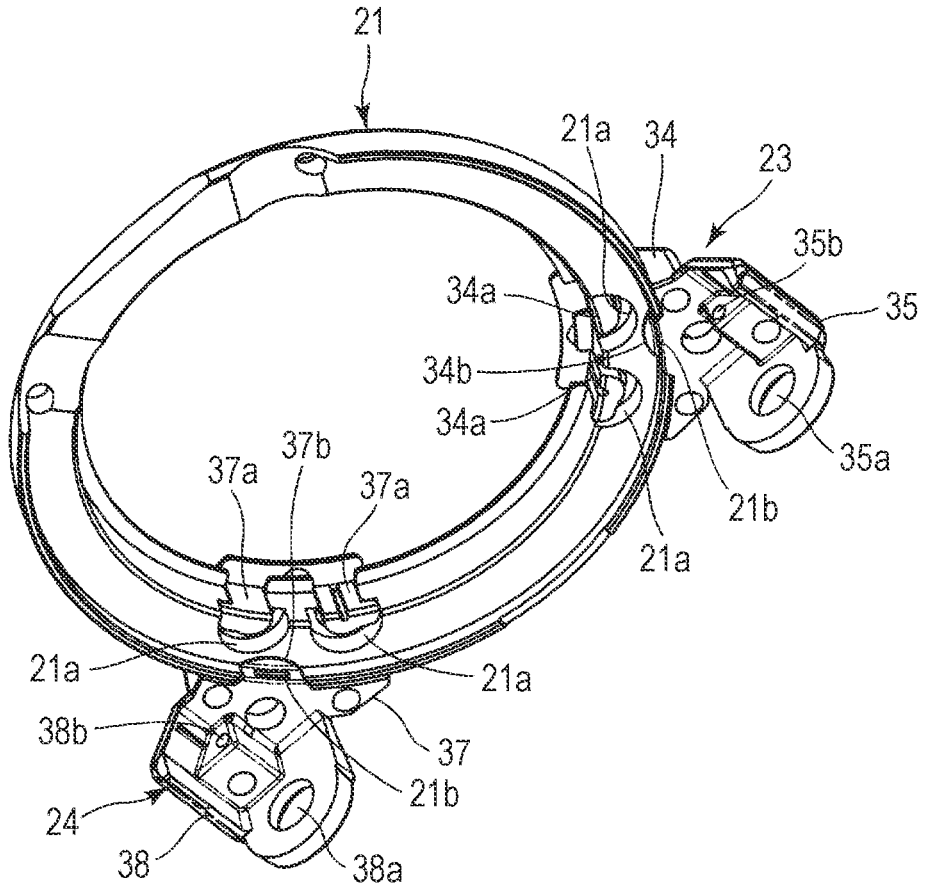
FIG. 7 is an enlarged perspective view of the second exterior member and the second and third exterior pieces of the first exterior member illustrated in FIG. 6 as viewed from the lower surface side.
Figure 8:
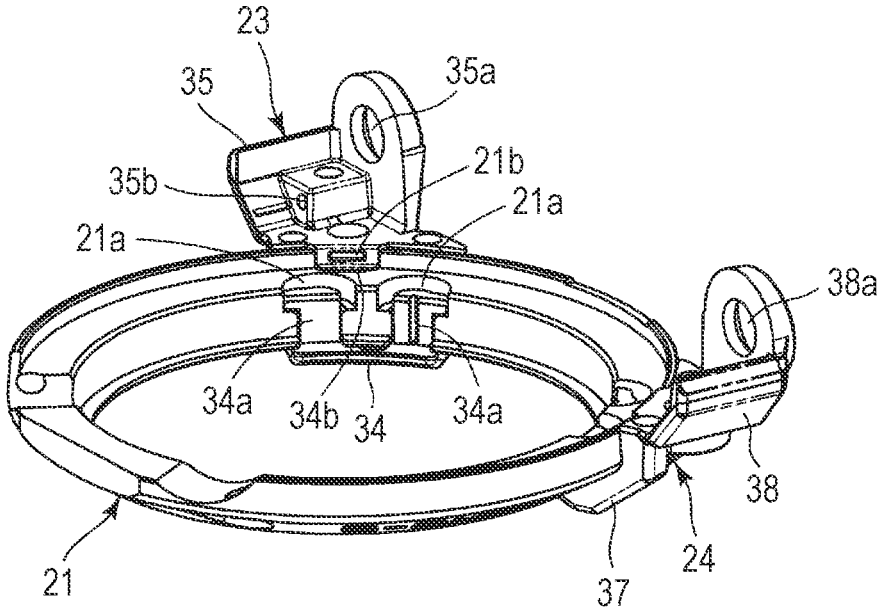
FIG. 8 is an enlarged perspective view illustrating the second exterior member illustrated in FIG. 7 and the second and third exterior pieces of the first exterior member inverted upside down.
Figure 9A:
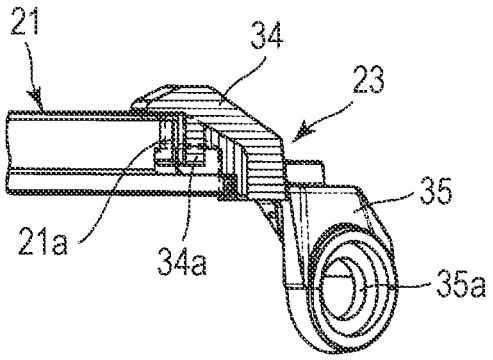
FIG. 9A is an enlarged cross-sectional view in a B-B arrow view of a cross section of the second exterior piece of the first exterior member attached to the second exterior member illustrated in FIG. 6.
Figure 9B:
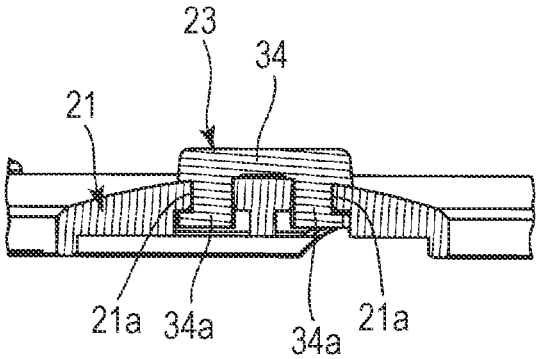
FIG. 9B is an enlarged cross-sectional view in a C-C arrow view of the cross section of the second exterior piece of the first exterior member attached to the second exterior member illustrated in FIG. 6.

As illustrated in FIGS. 6 to 8, the third exterior piece 24 is temporarily fixed as the third body portion 37 is attached to the substantially ring-shaped second exterior member 21. In this case as well, the pair of bit grooves 21*a* bit from the inner peripheral side toward the outer peripheral side and the locking groove 21*b* provided on an outer peripheral portion are provided at a portion of the second exterior member 21 to which the third body portion 37 is attached, which is similar to the second exterior piece 23. The third body portion 37 is provided with a pair of attachment protrusions 37*a* which are inserted and attached into the pair of bit grooves 21*a* of the second exterior member 21, and an engaging protrusion 37*b* that engages with the locking groove 21*b* of the second exterior member 21, which is similar to the second exterior piece 23.

As a result, the third exterior piece 24 is attached and temporarily fixed to the second exterior member 21 as the pair of attachment protrusions 37*a* of the third body portion 37 are inserted into the pair of bit grooves 21*a* of the second exterior member 21 and the engaging protrusion 37*b* of the third body portion 37 engages with the locking groove 21*b* of the second exterior member 21 when being arranged from the inner peripheral edge of the substantially ring-shaped second exterior member 21 to the outer peripheral surface of the upper case 18 through the upper surface of the second exterior member 21 as illustrated in FIGS. 6 to 8, which is similar to the second exterior piece 23.

In addition, as illustrated in FIGS. 4 to 8, the fourth cover portion 38 of the third exterior piece 24 is arranged so as to cover a side portion on the 1 o'clock side of the attachment protruding portion 17*a* provided in the lower case 17 to correspond to the band attachment portion 3 on the 12 o'clock side of the wristwatch case 1 and opposes the second cover portion 27 of the first exterior piece 22. As illustrated in FIGS. 10 and 11, the fourth cover portion 38 is provided with a fourth screw mounting hole 38*a* and a fourth connecting hole 38*b*.

The fourth cover portion 38 is configured such that the fourth screw mounting hole 38*a* corresponds to the body insertion hole 17*b* provided in the attachment protruding portion 17*a* of the lower case 17 along the outer periphery of the lower case 17, that is, in the tangential direction with respect to the outer periphery of the lower case 17 on the same axis, which is similar to the third cover portion 35 of the second exterior piece 23. As a result, the fourth cover portion 38 is attached to the attachment protruding portion 17*a* of the lower case 17 as the male screw 32 is screwed into the female screw portion 31*a* of the screw body 31 inserted into the body insertion hole 17*b* of the attachment protruding portion 17*a* through the fourth screw mounting hole 38*a*.

In addition, the fourth cover portion 38 is configured such that the fourth connecting hole 38*b* corresponds to the body connecting hole 17*c* provided in the attachment protruding portion 17*a* along the outer periphery of the lower case 17, that is, in the tangential direction with respect to the outer periphery of the lower case 17 on the same axis, which is similar to the third cover portion 35. As a result, the fourth cover portion 38 is connected and fixed to the end of the attachment protruding portion 17*a* so as to prevent the detachment from the attachment protruding portion 17*a* as the pin member 33, which are inserted into the body connecting hole 17*c* of the attachment protruding portion 17*a* and protrude from both the sides of the attachment protruding portion 17*a*, is inserted into the fourth connecting hole 38*b*.

Further, a fourth screw insertion hole 24*a* into which the third screw 36 is inserted is provided at a boundary between the third body portion 37 and the fourth cover portion 38 on the third exterior piece 24, which is similar to the second exterior piece 23. As a result, the third exterior piece 24 is attached to an upper end of the lower case 17 on the 1 o'clock side as the third screw 36 is inserted into the fourth screw insertion hole 24*a* from above and screwed into the third screw hole 17*e* provided at the upper end of the lower case 17 on the 1 o'clock side.

Figure 13:
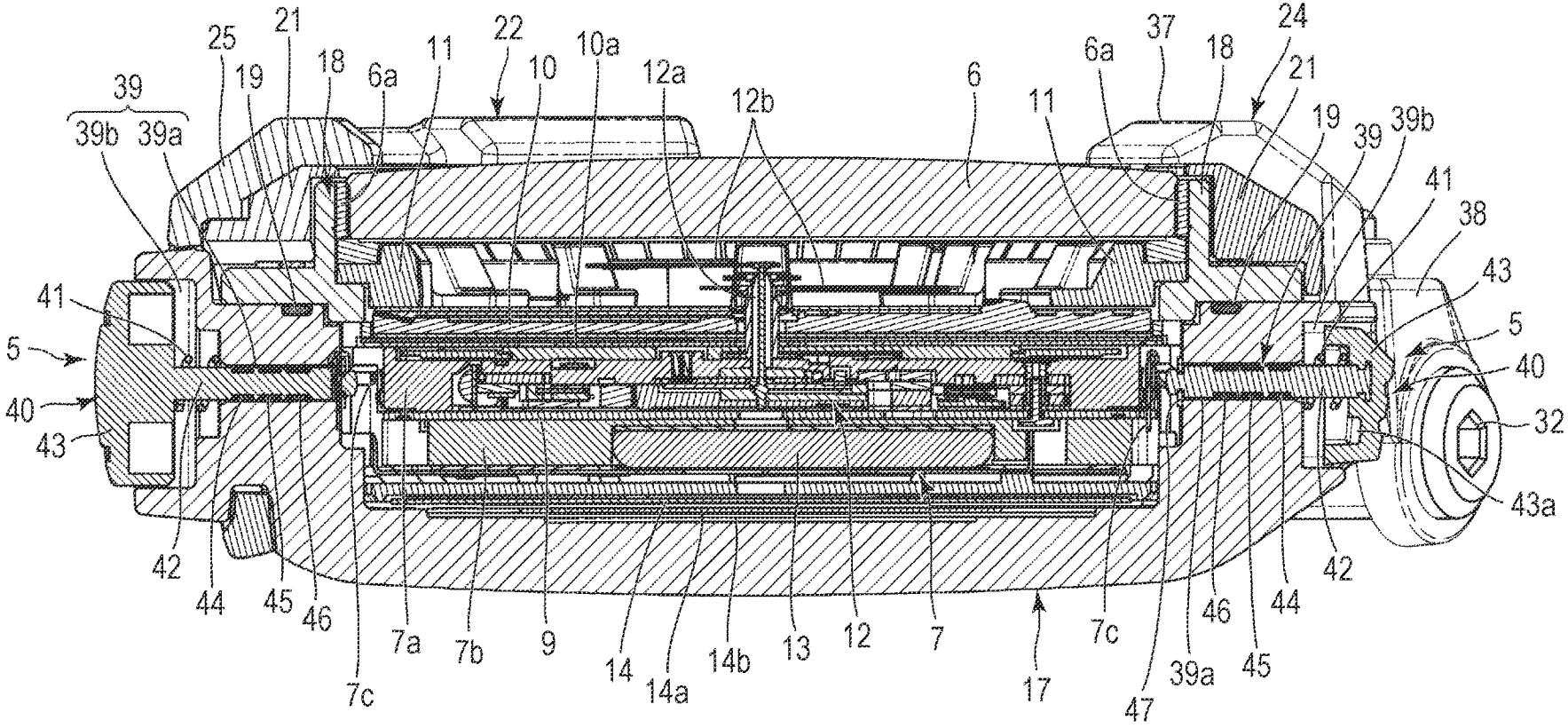
FIG. 13 is an enlarged cross-sectional view of the wristwatch illustrated in FIG. 1 in an H-H arrow view.
Figure 14:
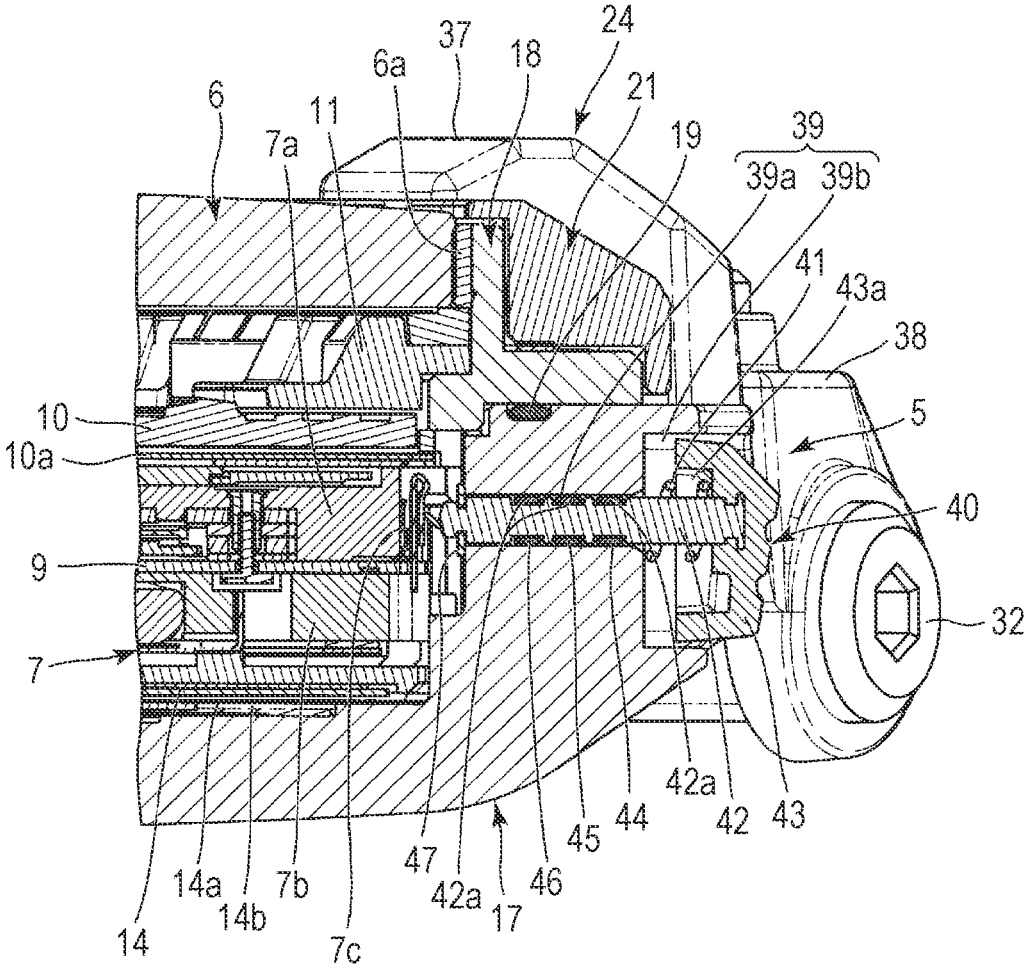
FIG. 14 is an enlarged cross-sectional view illustrating the main part of a pushbutton switch in the wristwatch illustrated in FIG. 13.

Meanwhile, as illustrated in FIGS. 1, 13 and 14, each of the plurality of pushbutton switches 5 of the wristwatch case 1 has substantially the same structure although installation position and sizes thereof are different. That is, the pushbutton switch 5 on the 1 o'clock side, for example, includes a first operating member 40 and a first spring member 41 among these plurality of pushbutton switches 5. Although the first operating member 40 includes a shaft portion 42 that is made of metal and is slidably inserted into a first through hole 39 of the lower case 17 and the head portion 43 that is made of a synthetic resin and is provided at an outer end of the shaft portion 42, the shaft portion 42 and the head portion 43 may be made of metal.

In this case, the first through hole 39 of the lower case 17 includes a small-diameter hole portion 39*a* into which the shaft portion 42 is inserted and a large-diameter hole portion 39*b* in which the head portion 43 is arranged as illustrated in FIG. 14. The shaft portion 42 is formed to be longer than an axial length of the small-diameter hole portion 39*a* of the first through hole 39. As a result, when the shaft portion 42 is configured such that an inner end protrudes inside the lower case 17 and the outer end protrudes inside the large-diameter hole portion 39*b* of the first through hole 39 when being inserted into the small-diameter hole portion 39*a*.

As illustrated in FIG. 14, the shaft portion 42 has a first retaining member 47 such as an E-ring attached to the inner end protruding inside the lower case 17, and is configured not to come out of the lower case 17 through the first through hole 39 as the first retaining member 47 separably abuts on the inner peripheral surface of the lower case 17. The shaft portion 42 is configured such that the inner end presses a contact portion 7*c* of the watch module 7 to perform a switch operation when the head portion 43 is pushed in. In addition, a plurality of gasket grooves 42*a* to which first to third gaskets 44 to 46 are attached are provided on an outer peripheral surface of the shaft portion 42.

As illustrated in FIG. 14, the head portion 43 is formed to have an outer diameter being slightly smaller than an inner diameter of the large-diameter hole portion 39*b* of the first through hole 39 and a recess 43*a* in which the first spring member 41 is arranged is provided on an inner end surface of the head portion 43. The first spring member 41 is a coil spring and has one end in elastic contact with a stepped portion of the large-diameter hole portion 39*b* and the other end in elastic contact with an inner surface of the recess 43*a* of the head portion 43, thereby biasing the head portion 43 in a direction of pushing the head portion 43 toward the outside of the lower case 17.

As a result, the pushbutton switch 5 is configured such that the outer end of the head portion 43 protrudes outward from the large-diameter hole portion 39*b* of the first through hole 39 in a state where the inner end of the head portion 43 is arranged in the large-diameter hole portion 39*b* of the first through hole 39 away from the stepped portion of the large-diameter hole portion 39*b* when the head portion 43 is pushed out by a spring force of the first spring member 41 and the first retaining member 47 of the shaft portion 42 abuts on the inner peripheral surface of the lower case 17 as illustrated in FIG. 14.

In addition, as illustrated in FIG. 14, the pushbutton switch 5 is configured such that the first spring member 41 is compressed and arranged in the recess 43*a* of the head portion 43 when the head portion 43 is pushed against the spring force of the first spring member 41 and the inner end of the head portion 43 approaches or comes into contact with the stepped portion of the large-diameter hole portion 39*b*, the first retaining member 47 of the shaft portion 42 protrudes inside the lower case 17 away from the inner peripheral surface of the lower case 17, and the inner end of the protruding shaft portion 42 presses the contact portion 7*c* of the watch module 7 to perform a switch operation.

In addition, the first to third gaskets 44 to 46 are attached to the shaft portion 42 of the pushbutton switch 5 as illustrated in FIG. 14. That is, these first to third gaskets 44 to 46 are arranged in the gasket grooves 42*a* of the shaft portion 42, respectively, on the outer periphery of the shaft portion 42 at predetermined intervals from the outer end side to the inner end side. In addition, these first to third gaskets 44 to 46 are configured such that outer peripheral portions of the first to third gaskets 44 to 46 are in slidable contact with an inner peripheral surface of the small-diameter hole portion 39*a* of the first through hole 39 when the shaft portion 42 is inserted into the small-diameter hole portion 39*a* of the first through hole 39.

In this case, the first gasket 44 is made of a material having heat resistance and chemical resistance, the material containing fluorine, for example, fluorine rubber. The second gasket 45 is made of a material having wear resistance and durability, less permanent strain caused by compression, and an excellent sliding property, for example, nitrile rubber. The third gasket 46 is made of a material having heat resistance and weather resistance, for example, butyl rubber.

As a result, the pushbutton switch 5 is configured to achieve high-pressure waterproofness as the heat resistance and chemical resistance are ensured by the first gasket 44 made of fluorine rubber to prevent the entry of liquids such as water, oil, and chemicals, the wear resistance, durability, and sliding property are ensured by the second gasket 45 made of nitrile rubber, which has less permanent strain caused by compression, to prevent the entry of water, and the heat resistance and weather resistance are ensured by the third gasket 46 made of butyl rubber to prevent the entry of a gas such as water vapor, thereby preventing fogging of the watch glass 6.

In this case, the first to third gaskets 44 to 46 are arranged in an order of the first gasket 44, the second gasket 45, and the third gasket 46 from the outer end side to the inner end side of the shaft portion 42 of the first operating member 40 as illustrated in FIG. 14. Thus, this pushbutton switch 5 is configured to efficiently achieve the high-pressure waterproofness since the fogging of the watch glass 6 is prevented by reliably preventing the entry of liquids such as oil and chemicals first by the first gasket 44, then, reliably preventing the entry of water by the second gasket 45, and reliably preventing the entry of the gas such as water vapor finally by the third gasket 46.

Figure 15:
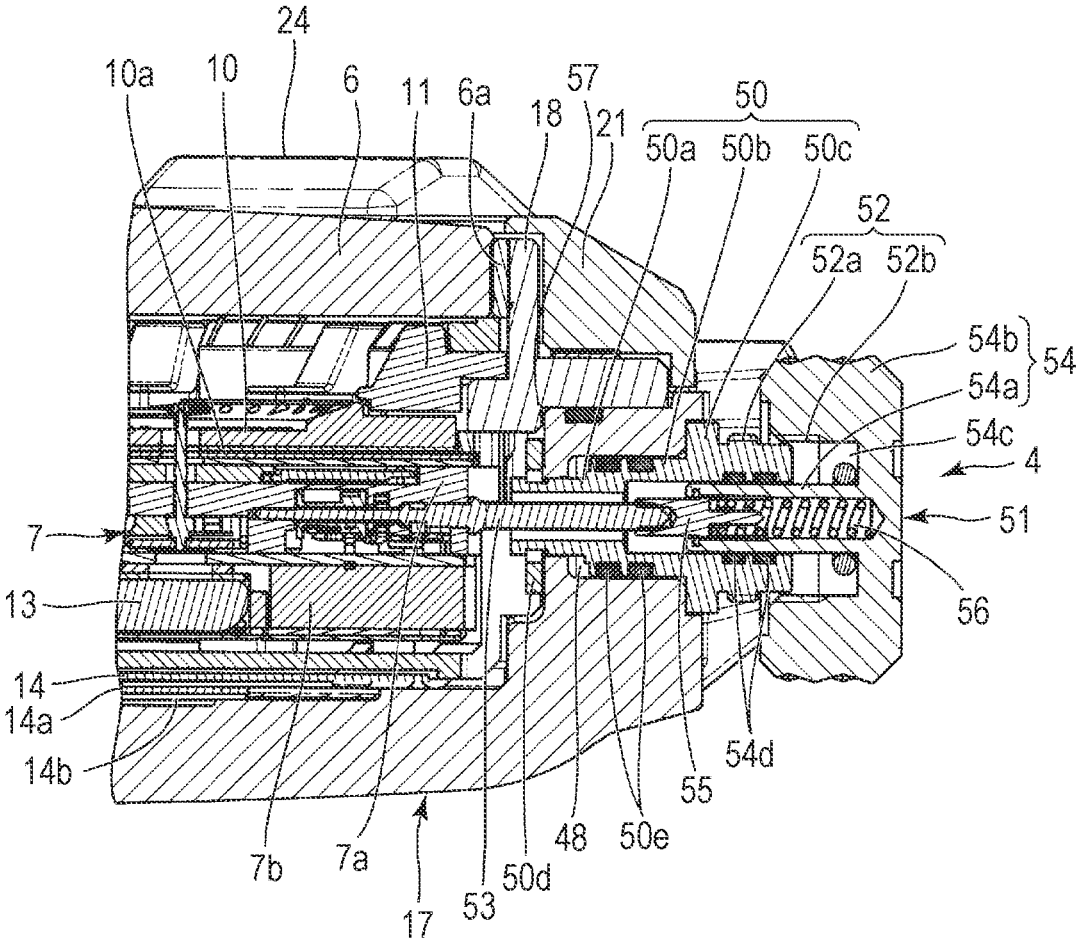
FIG. 15 is an enlarged cross-sectional view of the main part illustrating a state where an operating head portion is unlocked by a locking unit of an operating member in a switch device of the wristwatch illustrated in FIG. 2.

Meanwhile, the switch device 4 on the 3 o'clock side of the wristwatch case 1 includes: a tubular member 50 fitted in a second through hole 48 of the lower case 17; a second operating member 51 that is inserted into the tubular member 50 and protrudes to the outside of the lower case 17; and a locking unit 52 that locks the second operating member 51 as illustrated in FIGS. 2 and 15.

As illustrated in FIGS. 2 and 15, the tubular member 50 includes: a small-diameter tube portion 50*a* inserted into a small-diameter hole portion of the second through hole 48 of the lower case 17; a medium-diameter tube portion 50*b* inserted into a medium-diameter hole portion of the second through hole 48; and a large-diameter tube portion 50*c* inserted into a large-diameter hole portion of the second through hole 48, and these are made of metal such as stainless steel. In this case, in the tubular member 50, an inner end of the small-diameter tube portion 50*a* protrudes inside the lower case 17, and a second retaining member 50*d* is attached to the protruding inner end.

In addition, the tubular member 50 is provided with a plurality of waterproof gaskets 50*e* on an outer periphery of the medium-diameter tube portion 50*b* as illustrated in FIGS. 2 and 15. As a result, the plurality of waterproof gaskets 50*e* are in elastic contact with an inner peripheral surface of the medium-diameter hole portion of the second through hole 48 in the tubular member 50 so that waterproofness with respect to the second through hole 48 of the lower case 17 is achieved.

As illustrated in FIGS. 2 and 15, the second operating member 51 includes an operating shaft 53 that is a winding stem, an operating head portion 54 that is connected to an outer end of the operating shaft 53, a connecting block 55 that connects the operating shaft 53 and the operating head portion 54, and a second spring member 56 that biases the operating head portion 54 toward the outside of the lower case 17. The operating shaft 53 has an inner end slidably inserted into the watch module 7, and an outer end slidably arranged in the tubular member 50.

As illustrated in FIGS. 2 and 15, the operating head portion 54 includes a cylinder shaft 54*a* that is slidably inserted into the medium-diameter tube portion 50*b* of the tubular member 50, and an outer head portion 54*b* provided at an outer end of the cylinder shaft 54*a*. A plurality of waterproof rings 54*d* are slidably provided in elastic contact with the inner peripheral surface of the tubular member 50 on an outer periphery of the cylinder shaft 54*a*. In addition, the connecting block 55 and the second spring member 56 are arranged in the cylinder shaft 54*a*, and an outer end of the operating shaft 53 is inserted in the cylinder shaft 54*a*. In this case, the outer end of the operating shaft 53 is connected to the connecting block 55.

As illustrated in FIGS. 2 and 15, the connecting block 55 is slidably arranged in the cylinder shaft 54*a*, and is configured to idle with respect to the operating head portion 54 and not to transmit the rotation of the operating head portion 54 to the operating shaft 53 in a neutral state where the operating head portion 54 is pushed out to the outside of the lower case 17 by the spring force of the second spring member 56.

In addition, when the operating head portion 54 is further pulled out from the neutral state toward the outside of the lower case 17, the connecting block 55 maintains a stationary state without moving even if the cylinder shaft 54*a* slides and engages with the cylinder shaft 54*a* in the cylinder shaft 54*a* so as to transmit the rotation of the operating head portion 54 to the operating shaft 53 as illustrated in FIGS. 2 and 15.

As illustrated in FIGS. 2 and 15, the locking unit 52 is a screw lock mechanism and includes a male screw 52*a* provided on an outer peripheral surface of the large-diameter tube portion 50*c* of the tubular member 50 and a female screw 52*b* provided on the inner peripheral surface of the recess 54*c* in the outer head portion 54*b* of the operating head portion 54. In this case, the recess 54*c* provided in the outer head portion 54*b* of the operating head portion 54 is formed to have a size in which an inner diameter thereof is similar to an outer diameter of the large-diameter tube portion 50*c* of the tubular member 50.

As a result, the locking unit 52 is locked as the female screw 52*b* of the recess 54*c* is screwed into the male screw 52*a* of the large-diameter tube portion 50*c* while the large-diameter tube portion 50*c* of the tubular member 50 is pushed into the recess 54*c* of the outer head portion 54*b* of the operating head portion when the operating head portion 54 in the neutral state where the connecting block 55 idles is rotated in one direction while being pushed into the inside of the lower case 17 against the spring force of the second spring member 56 as illustrated in FIGS. 2 and 15.

In addition, the locking unit 52 is turned into the neutral state as the screw between the male screw 52*a* of the large-diameter tube portion 50*c* and the female screw 52*b* of the recess 54*c* is loosened, the lock by the male screw 52*a* and the female screw 52*b* is released, and the operating head portion 54 is pushed out to the outside of the lower case 17 by the spring force of the second spring member 56 when the operating head portion 54 is rotated in a direction opposite to the one direction in the state where the male screw 52*a* of the large-diameter tube portion 50*c* and the female screw 52*b* of the recess 54*c* are screwed with each other as illustrated in FIGS. 2 and 15.

As a result, the switch device 4 is configured such that the connecting block 55 idles with respect to the operating head portion 54 so as not to rotate the operating shaft 53, the watch movement 12 of the watch module 7 is not operated, and the time or the like is not corrected even if the operating head portion 54 is rotated since the cylinder shaft 54*a* of the operating head portion 54 and the connecting block 55 are not engaged when the lock of the operating head portion 54 by the locking unit 52 is released and the operating head portion 54 is in the neutral state of being pushed out to the outside of the lower case 17 by the spring force of the second spring member 56 as illustrated in FIGS. 2 and 15.

In addition, this switch device 4 is configured such that the time or the like is corrected as the connecting block 55 rotates along with the rotation of the operating head portion 54 to rotate the operating shaft 53 in the watch module 7 and to operate the watch movement 12 in the watch module 7 since the cylinder shaft 54*a* of the operating head portion 54 and the connecting block 55 engage with each other when the lock of the operating head portion 54 by the locking unit 52 is released and the operating head portion 54 in the neutral state is further pulled out to the outside of the lower case 17 as illustrated in FIGS. 2 and 15.

Meanwhile, the upper case 18 is provided with an impact receiving portion 57 on which the inner peripheral portion which is a part of the lower case 17 corresponding to the switch device 4 abuts as illustrated in FIGS. 2, 5, and 15. That is, the impact receiving portion 57 is provided to protrude from an outer peripheral surface of the second ring portion 18*b* of the upper case 18 on a lower surface of the first ring portion 18*a* of the upper case 18 corresponding to the second operating member 51 of the switch device 4 and abuts on the inner peripheral portion of the lower case 17 in the axial direction of the operating shaft 53.

In this case, the outer peripheral portion of the lower case 17 is provided so as to protrude outward from the outer peripheral surface of the upper case 18, and is configured such that the second operating member 51 is inserted into the tubular member 50 fitted in the second through hole 48 of the lower case 17 as illustrated in FIGS. 2 and 15. As a result, the switch device 4 is configured such that an impact is received by the lower case 17 via the tubular member 50 when the operating head portion 54 of the second operating member 51 receives the impact from the outside.

Thus, even if the operating head portion 54 of the second operating member 51 receives the impact from the outside and the lower case 17 made of a synthetic resin is deformed by the impact in this switch device, the inner peripheral portion of the lower case 17 is pressed against the impact receiving portion 57 of the upper case 18 made of metal so that the impact from the outside is received by the impact receiving portion 57 as illustrated in FIGS. 2 and 15.

As a result, the switch device 4 is configured such that the operating shaft 53 of the second operating member 51 is not pushed into the watch module 7 by the impact since the impact from the outside is received by the impact receiving portion 57, and thus, the watch module 7 is prevented from being damaged by the operating shaft 53 even if the operating head portion 54 of the second operating member 51 receives the impact from the outside as illustrated in FIGS. 2 and 15.

In this case, the upper case 18 is positioned on the lower case 17 by a positioning unit 58 as illustrated in FIG. 5. That is, the positioning unit 58 includes a pair of notch portions 58*a* provided on the outer peripheral portion of the first ring portion 18*a* of the upper case 18 on the 12 o'clock side and the 6 o'clock side, respectively, and a pair of protruding portions (not illustrated) which are provided at the upper end of the side wall of the lower case 17 and engage with the pair of notch portions 58*a* of the upper case 18.

As a result, the upper case 18 is configured such that the position along the outer periphery with respect to the lower case 17 is accurately positioned as the pair of protruding portions (not illustrated) provided at the upper end of the lower case 17 engage with the pair of notch portions 58*a* provided in the first ring portion 18*a* of the upper case 18 when the first ring portion 18*a* is arranged at the upper end of the side wall of the lower case 17 as illustrated in FIGS. 2, 5, and 15. In this case, as the upper case 18 is positioned with respect to the lower case 17 by the positioning unit 58, the impact receiving portion 57 of the upper case 18 is arranged so as to correspond to the switch device 4.

Next, a function of the above wristwatch will be described.

First, a case of assembling the wristwatch will be described. In this case, the piezoelectric element 14 is attached inside the lower case 17. At this time, the piezoelectric element 14 is attached on the vibrating plate 14*a*, and the vibrating plate 14*a* is pasted to the bottom of the lower case 17 with the double-sided adhesive tape 14*b*. In this state, the plurality of pushbutton switches 5 and the switch device 4 are attached to the lower case 17.

That is, when the plurality of pushbutton switches 5 are attached to the lower case 17, the first to third gaskets 44 to 46 are attached respectively to the plurality of gasket grooves 42*a* provided on the outer periphery of each of the shaft portions 42 of each of the first operating members 40 in advance. At this time, the first gasket 44, the second gasket 45, and the third gasket 46 are attached in this order from the outer end side to the inner end side of the shaft portion 42. In this state, the first spring member 41 is arranged on the outer periphery of the shaft portion 42 of the first operating member 40, and the shaft portion 42 is inserted into the first through hole 39 of the lower case 17 from the outside.

Then, the first spring member 41 is arranged between the stepped portion of the large-diameter hole portion 39*b* of the first through hole 39 and the inner surface of the recess 43*a* of the head portion 43 of the first operating member 40. In this state, the head portion 43 is pushed to cause the inner end of the shaft portion 42 to protrude inside the lower case 17, and the first retaining member 47 is attached to the protruding inner end of the shaft portion 42. In this state, the head portion 43 is pushed out by the spring force of the first spring member 41, the first retaining member 47 of the shaft portion 42 abuts on the inner peripheral surface of the lower case 17, and the shaft portion 42 does not come out from the lower case 17 to the outside.

In addition, at this time, the inner end of the head portion 43 of the pushbutton switch 5 is arranged in the large-diameter hole portion 39*b* of the first through hole 39 in the state of being away from the stepped portion of the large-diameter hole portion 39*b*, and the outer end of the head portion 43 is arranged to protrude from the inside of the large-diameter hole portion 39*b* to the outside of the lower case 17. In this state, the outer peripheral portions of the first to third gaskets 44 to 46 are slidably in elastic contact with the small-diameter hole portion 39*a* of the first through hole 39.

In such a state, the heat resistance and chemical resistance are ensured by the first gasket 44 made of fluorine rubber to prevent the entry of liquids such as oil and chemicals, the wear resistance, durability, and sliding property are ensured by the second gasket 45 made of nitrile rubber, which has less permanent strain caused by compression, to prevent the entry of water, and the heat resistance and weather resistance are ensured by the third gasket 46 made of butyl rubber to prevent the entry of a gas such as water vapor, thereby preventing the fogging of the watch glass 6. Thus, the pushbutton switch 5 achieves the high-pressure waterproofness.

In addition, the plurality of gaskets 44 to 46 are arranged in the order of the first gasket 44, the second gasket 45, and the third gasket 46 from the outer end side to the inner end side of the shaft portion 42 of the first operating member 40 in this case. In this state, the entry of liquids such as oil and chemicals is reliably prevented first by the first gasket 44, then, the entry of water is reliably prevented by the second gasket 45, and the entry of a gas such as water vapor is prevented finally by the third gasket 46, thereby preventing the fogging of the watch glass 6. This also achieves the high-pressure waterproofness of the pushbutton switch 5. In this manner, the plurality of pushbutton switches 5 are attached to the lower case 17 on the 2 o'clock side, 4 o'clock side, 8 o'clock side, and 10 o'clock side, respectively.

On the other hand, when the switch device 4 is attached to the lower case 17, the tubular member 50 is first attached to the second through hole 48 of the lower case 17. At this time, the plurality of waterproof gaskets 50*e* are attached in advance to the outer peripheral surface of the medium-diameter tube portion 50*b* of the tubular member 50. In this state, the tubular member 50 is fitted into the second through hole 48 of the lower case 17 together with the plurality of waterproof gaskets 50*e*. At this time, the small-diameter tube portion 50*a* of the tubular member 50 is arranged in the small-diameter hole portion of the second through hole 48, the medium-diameter tube portion 50*b* is arranged in the medium-diameter hole portion of the second through hole 48, and the large-diameter tube portion 50*c* is arranged in the large-diameter hole portion of the second through hole 48.

In this state, the plurality of waterproof gaskets 50*e* are in elastic contact with the inner peripheral surface of the medium-diameter hole portion of the second through hole 48, so that the waterproofness between the second through hole 48 of the lower case 17 and the tubular member 50 is achieved. In addition, at this time, the inner end of the small-diameter tube portion 50*a* of the tubular member 50 protrudes inside the lower case 17, and the second retaining member 50*d* is attached to the protruding inner end. As a result, the tubular member 50 is attached to the second through hole 48 without coming out of the second through hole 48.

In this state, the watch module 7 is incorporated inside the lower case 17 from above. At this time, the watch module 7 is assembled in advance such that the dial 10 is arranged in the upper portion of the watch module 7 together with the solar panel 10*a*, and the middle frame 8 is attached to the outer periphery of the watch module 7. In this state, the watch module 7 is arranged inside the lower case 17 together with the middle frame 8 to cause the plurality of contact portions 7*c* of the watch module 7 to correspond to the inner ends of the shaft portions 42 of the plurality of pushbutton switches 5.

Further, the second operating member 51 of the switch device 4 is attached to the tubular member 50 which has been attached to the lower case 17. At this time, the connecting block 55 is connected in advance to the outer end of the operating shaft 53 of the second operating member 51. In this state, the second spring member 56 is inserted into the cylinder shaft 54*a* provided on the operating head portion 54 of the second operating member 51, and the connecting block 55 is inserted to insert the outer end of the operating shaft 53.

As a result, the operating shaft 53 is connected to the cylinder shaft 54*a* of the operating head portion 54 by the connecting block 55. In this state, the operating shaft 53 is inserted into the tubular member 50 from the outside of the lower case 17 and inserted into the watch module 7 inside the lower case 17. Then, the operating shaft 53 is operably connected to the watch movement 12 of the watch module 7. As a result, the switch device 4 is attached to the lower case 17.

Thereafter, the upper case 18 made of metal is attached to the lower case 17 made of a synthetic resin to assemble the case body 15. At this time, the waterproof ring 19 is arranged in advance at the upper end of the tubular side wall of the lower case 17. In addition, at this time, the parting member 11 is arranged inside the tubular portion 18*c* of the upper case 18 in advance, and the watch glass 6 is attached together with the gasket 6*a*. In this case, the watch glass 6 is fitted into the tubular portion 18*c* of the upper case 18 via the gasket 6*a* so that the watch glass 6 is protected by the upper case 18, which is more rigid than the lower case 17, and the waterproofness of the upper case 18 is ensured.

When the upper case 18 is attached to the lower case 17 in this state, the first ring portion 18*a* of the upper case 18 is arranged at the upper end of the tubular side wall of the lower case 17, and further, the second ring portion 18*b* of the upper case 18 is arranged so as to correspond to the inner surface of the side wall of the lower case 17. At this time, the upper case 18 and the lower case 17 are accurately positioned by the positioning unit 58. Thus, the impact receiving portion 57 provided on the second ring portion 18*b* is accurately arranged to correspond to the switch device 4 attached to the lower case 17.

Further, the first ring portion 18*a* of the upper case 18 is attached to the upper end of the tubular side wall of the lower case 17 by the plurality of screws 18*d*. In this case, the upper case 18 ensures the entire strength of the case body 15 even if the lower case 17 is made of a synthetic resin. That is, the opening portion of the tubular side wall of the lower case 17 is reinforced by the upper case 18 made of metal even if the lower case 17 has the structure having the tubular side wall and the bottom, and thus, the entire rigidity of the case body 15 is enhanced.

In addition, at this time, the lower case 17 is formed using the synthetic resin, the manufacturing work is simple, the manufacturing cost is reduced, and the price is reduced as compared to the case of forming the lower case 17 using metal. In this case, the upper case 18 is attached to the lower case 17 with the waterproof ring 19 sandwiched between the first ring portion 18*a* of the upper case 18 and the upper end of the side wall of the lower case 17. Thus, the waterproofness of the case body 15 is achieved by the waterproof ring 19. As a result, the case body 15 is assembled.

In this state, the exterior member 16 is attached to the case body 15. At this time, the exterior member 16 is assembled in advance. That is, the second exterior piece 23 and the third exterior piece 24 of the first exterior member 20 are attached to the second exterior member 21. In this case, when the second exterior piece 23 is attached to the second exterior member 21, the second exterior piece 23 is arranged from the inner peripheral edge of the substantially ring-shaped second exterior member 21 to the outer peripheral surface of the upper case 18 through the upper surface of the second exterior member 21.

At this time, the pair of attachment protrusions 34*a* provided on the second body portion 34 of the second exterior piece 23 are inserted into the pair of bit grooves 21*a* of the second exterior member 21 so that the engaging protrusion 34*b* of the second body portion 34 is engaged with the locking groove 21*b* of the second exterior member 21. As a result, the second exterior piece 23 is attached and temporarily fixed to the second exterior member 21.

Similarly, when the third exterior piece 24 is attached to the second exterior member 21, the third exterior piece 24 is arranged from the inner peripheral edge of the substantially ring-shaped second exterior member 21 to the outer peripheral surface of the upper case 18 through the upper surface of the second exterior member 21. At this time as well, the pair of attachment protrusions 37*a* provided on the third body portion 37 of the third exterior piece 24 are inserted into the pair of bit grooves 21*a* of the second exterior member 21 so that the engaging protrusion 37*b* of the third body portion 37 is engaged with the locking groove 21*b* of the second exterior member 21. As a result, the third exterior piece 24 is attached and temporarily fixed to the second exterior member 21.

Then, the second exterior member 21 to which the second exterior piece 23 and the third exterior piece 24 have been attached is mounted on the upper case 18 and attached to the lower case 17. That is, when the second exterior member 21 is mounted on the upper case 18, the second exterior member 21 is arranged in the upper case 18 in a state where the second exterior member 21 covers the upper surface of the first ring portion 18*a* of the upper case 18 and the outer peripheral surface of the tubular portion 18*c*.

At this time, the third cover portion 35 of the second exterior piece 23 attached to the second exterior member 21 corresponds to the side portion on the 5 o'clock side of the attachment protruding portion 17*a* provided on the 6 o'clock side of the lower case 17 to cover the side portion of the attachment protruding portion 17*a* on the 5 o'clock side. Similarly, the fourth cover portion 38 of the third exterior piece 24 attached to the second exterior member 21 corresponds to the side portion on the 1 o'clock side of the attachment protruding portion 17*a* provided on the 12 o'clock side of the lower case 17 to cover the side portion of the attachment protruding portion 17*a* on the 1 o'clock side.

At this time, the third screw mounting hole 35*a* provided in the third cover portion 35 of the second exterior piece 23 corresponds to the body insertion hole 17*b* provided in the attachment protruding portion 17*a* provided on the 6 o'clock side of the lower case 17 in the tangential direction with respect to the outer periphery of the lower case 17 on the same axis. At the same time, the third connecting hole 35*b* provided in the third cover portion 35 corresponds to the body connecting hole 17*c* provided in the attachment protruding portion 17*a* on the 6 o'clock side in the tangential direction to the outer periphery of the lower case 17 on the same axis. In addition, at this time, the third screw insertion hole 23*a* provided at the boundary between the second body portion 34 and the third cover portion 35 corresponds to the third screw hole 17*e* provided at the upper end of the lower case 17 on the 5 o'clock side.

Similarly, the fourth screw mounting hole 38*a* provided in the fourth cover portion 38 of the third exterior piece 24 corresponds to the body insertion hole 17*b* provided in the attachment protruding portion 17*a* provided on the 12 o'clock side of the lower case 17 in the tangential direction with respect to the outer periphery of the lower case 17 on the same axis. At the same time, the fourth connecting hole 38*b* provided in the fourth cover portion 38 corresponds to the body connecting hole 17*c* of the attachment protruding portion 17*a* on the 12 o'clock side on the same axis. In addition, at this time, the fourth screw insertion hole 24*a* provided at the boundary between the third body portion 37 and the fourth cover portion 38 corresponds to the third screw hole 17*e* provided at the upper end of the lower case 17 on the 1 o'clock side.

In this case, the pin members 33 are inserted respectively to the body connecting holes 17*c* provided in advance in the tangential direction with respect to the outer periphery of the lower case 17 in the respective attachment protruding portions 17*a* provided on the 6 o'clock side and the 12 o'clock side of the lower case 17, thereby causing each of the pin members 33 to protrude on both sides of each of the body connecting holes 17*c*. As a result, when the third connecting hole 35*b* of the third cover portion 35 of the second exterior piece 23 corresponds to the body connecting hole 17*c* of the attachment protruding portion 17*a* on the 6 o'clock side, the pin member 33 protruding from both ends of the body connecting hole 17*c* is inserted into the third connecting hole 35*b* of the third cover portion 35.

Similarly, when the fourth connecting hole 38*b* of the fourth cover portion 38 of the third exterior piece 24 corresponds to the body connecting hole 17*c* provided in the attachment protruding portion 17*a* on the 12 o'clock side in the tangential direction with respect to the outer periphery of the lower case 17, the pin member 33 protruding from both ends of the body connecting hole 17*c* is inserted into the fourth connecting hole 38*b* of the fourth cover portion 38. In this manner, when the respective pin members 33 are inserted into the third connecting hole 35*b* of the third cover portion 35 and the fourth connecting hole 38*b* of the fourth cover portion 38, the second exterior member 21 presses the upper case 18 onto the lower case 17.

In this state, the third screw 36 is inserted into the third screw insertion hole 23*a* of the second exterior piece 23 from above, and is screwed and tightened with the third screw hole 17*e* provided at the upper end on the 5 o'clock side of the lower case 17. As a result, the second exterior piece 23 presses the second exterior member 21 and the upper case 18 and is attached to the lower case 17. Similarly, the third screw 36 is inserted into the fourth screw insertion hole 24*a* of the third exterior piece 24 from above and is screwed and tightened with the third screw hole 17*e* provided at the upper end on the 1 o'clock side of the lower case 17. As a result, the third exterior piece 24 presses the second exterior member 21 and the upper case 18 and is attached to the lower case 17.

Further, the first exterior piece 22 of the first exterior member 20 is attached to the side surface of the case body 15 from the 12 o'clock side to the 6 o'clock side through the 9 o'clock side. At this time, the exterior body portion 25 of the first exterior piece 22 is set to correspond to the side surface of the case body 15 from the 8 o'clock side to the 10 o'clock side. At the same time, the first cover portion 26 of the first exterior piece 22 is set to correspond to the end on the 7 o'clock side of the attachment protruding portion 17*a* provided on the 6 o'clock side of the lower case 17, and the second cover portion 27 of the first exterior piece 22 is set to correspond to the end on the 11 o'clock side of the attachment protruding portion 17*a* provided on the 12 o'clock side of the lower case 17.

At this time, the head portions 43 of the respective pushbutton switches 5 provided on the 8 o'clock side and the 10 o'clock side of the case body 15 are inserted and arranged inside the respective button insertion holes 25*a* provided in the exterior body portion 25 of the first exterior piece 22, and the second screw insertion hole 25*c* provided in the exterior body portion 25 corresponds to the second screw hole 17*c* provided in the side wall of the lower case 17. In addition, at this time, each of the first screw insertion holes 25*b* provided in the upper portion of the exterior body portion 25 passes through each of the holes of the second exterior member 21 and the first ring portion 18*a* of the upper case 18 and corresponds to the first screw hole 17*d* provided at the upper end of the lower case 17.

In addition, at this time, the first cover portion 26 of the first exterior piece 22 is arranged so as to cover the end on the 7 o'clock side of the attachment protruding portion 17*a* provided on the 6 o'clock side of the lower case 17, and opposes the second exterior piece 23 and the third cover portion 35 with the attachment protruding portion 17*a* sandwiched therebetween. In this state, the first screw mounting hole 26*a* of the first cover portion 26 corresponds to the body insertion hole 17*b* of the attachment protruding portion 17*a* on the same axis.

In addition, at this time, the first connecting hole 26*b* of the first cover portion 26 corresponds to the body connecting hole 17*c* of the attachment protruding portion 17*a* on the same axis. Then, the pin member 33, which is inserted into the body connecting hole 17*c* of the attachment protruding portion 17*a* and protrudes on both sides of the body connecting hole 17*c*, is inserted into the first connecting hole 26*b* of the first cover portion 26. As a result, the first cover portion 26 is connected and fixed to the attachment protruding portion 17*a*, and the first cover portion 26 can be prevented from being detached from the attachment protruding portion 17*a*.

Similarly, the second cover portion 27 of the first exterior piece 22 is arranged so as to cover the end on the 11 o'clock side of the attachment protruding portion 17*a* provided on the 12 o'clock side of the lower case 17, and opposes the third exterior piece 24 and the fourth cover portion 38 with the attachment protruding portion 17*a* sandwiched therebetween. In this state, the second screw mounting hole 27*a* of the second cover portion 27 corresponds to the body insertion hole 17*b* of the attachment protruding portion 17*a* on the same axis.

In addition, at this time, the second connecting hole 27*b* of the second cover portion 27 corresponds to the body connecting hole 17*c* of the attachment protruding portion 17*a* on the same axis. Then, the pin member 33, which is inserted into the body connecting hole 17*c* of the attachment protruding portion 17*a* and protrudes on both sides of the body connecting hole 17*c*, is inserted into the second connecting hole 27*b* of the second cover portion 27. As a result, the second cover portion 27 is connected and fixed to the attachment protruding portion 17*a*, and the second cover portion 27 can be prevented from being detached from the attachment protruding portion 17*a*.

In this state, the first exterior member 20 is screwed to the case body 15. At this time, the first screws 28 are inserted into the first screw insertion holes 25*b* provided in the upper part of the exterior body portion 25 of the first exterior piece 22, respectively, from above to cause the respective first screws 28 to pass through the second exterior member 21 and the first ring portion 18*a* of the upper case 18 and to be screwed and tightened with the respective first screw holes 17*d* provided in the upper end of the lower case 17. As a result, the exterior body portion 25 presses the second exterior member 21 and the upper case 18 and is attached to the lower case 17.

In addition, in this state, the second screw 29 is inserted into the second screw insertion hole 25*c* provided in the side portion of the exterior body portion 25 from the outer lateral side to cause the second screw 29 to be screwed and tightened with the second screw hole 17*c* provided on the side wall of the lower case 17. As a result, the exterior body portion 25 of the first exterior piece 22 is attached to the lower case 17.

Further, in this state, the screw body 31 of the mounting screw member 30 is inserted from the first screw mounting hole 26*a* provided in the first cover portion 26 of the first exterior piece 22 into the body insertion hole 17*b* provided in the attachment protruding portion 17*a* of the lower case 17. Further, the male screw 32 of the mounting screw member 30 is inserted into the first screw mounting hole 26*a* of the first cover portion 26, and is screwed and tightened with the female screw portion 31*a* of the screw body 31 inserted into the body insertion hole 17*b* of the attachment protruding portion 17*a*.

At this time, the male screw 32 of the mounting screw member 30 is inserted into the third screw mounting hole 35*a* of the third cover portion 35 of the second exterior piece 23 opposing the first cover portion 26 of the first exterior piece 22, and is screwed and tightened with the female screw portion 31*a* of the screw body 31 inserted into the body insertion hole 17*b* of the attachment protruding portion 17*a*. As a result, the first cover portion 26 of the first exterior piece 22 and the third cover portion 35 of the second exterior piece 23 are attached to both ends of the attachment protruding portions 17*a* of the lower case 17.

Similarly, the screw body 31 of the mounting screw member 30 is inserted from the second screw mounting hole 27*a* provided in the second cover portion 27 of the first exterior piece 22 into the body insertion hole 17*b* provided in the attachment protruding portion 17*a* of the lower case 17. Further, the male screw 32 of the mounting screw member 30 is inserted into the second screw mounting hole 27*a* of the second cover portion 27, and is screwed and tightened with the female screw portion 31*a* of the screw body 31 inserted into the body insertion hole 17*b* of the attachment protruding portion 17*a*.

At this time, the male screw 32 of the mounting screw member 30 is inserted into the fourth screw mounting hole 38*a* of the fourth cover portion 38 of the third exterior piece 24 opposing the second cover portion 27, and is screwed and tightened with the female screw portion 31*a* of the screw body 31 inserted into the body insertion hole 17*b* of the attachment protruding portion 17*a*. As a result, the second cover portion 27 of the first exterior piece 22 and the fourth cover portion 38 of the third exterior piece 24 are attached to both ends of the attachment protruding portion 17*a*.

As a result, the wristwatch is assembled. In this case, the exterior member 16 and the case body 15 are connected and fixed by the pin member 33 in the wristwatch case 1 of the wristwatch assembled in this manner, and thus, a reduction is size is achieved as compared to the case where the exterior member 16 and the case body 15 are screwed with each other. Further, the disassembly work is easier, and the reassembly and maintenance are easier as compared to a case where the exterior member 16 and the case body 15 are fixed with an adhesive or a double-sided adhesive tape.

Next, a case of using the wristwatch will be described.

In a normal state of this wristwatch, each of the plurality of watch movements 12 of the watch module 7 moves the pointer 12*b* above the dial 10 to indicate and display information such as the time, and the information such as the time thus indicated and displayed is viewed from the outside through the watch glass 6.

If the plurality of pushbutton switches 5 are pressed in this state, a mode of the watch is switched. That is, when the head portion 43 of the first operating member 40 is pressed against the spring force of the first spring member 41, the shaft portion 42 slides and is pushed inside the small-diameter hole portion 39*a* of the first through hole 39. Then, the inner end of the shaft portion 42 is pushed into the lower case 17 and presses the contact portion 7*c* of the watch module 7 to perform a switch operation.

When the head portion 43 of the first operating member 40 is pushed and the shaft portion 42 slides inside the small-diameter hole portion 39*a* of the first through hole 39 in this manner, the outer peripheral portions of the first to third gaskets 44 to 46 provided on the outer periphery of the shaft portion 42 slide in the state of being in elastic contact with the inner peripheral surface of the small-diameter hole portion 39*a* of the first through hole 39. Thus, the first to third gaskets 44 to 46 achieve the high-pressure waterproofness between the shaft portion 42 of the first operating member 40 and the small-diameter hole portion 39*a* of the first through hole 39.

That is, in this pushbutton switch 5, the high-pressure waterproofness is achieved since the heat resistance and chemical resistance are ensured by the first gasket 44 made of fluorine rubber to prevent the entry of liquids such as oil and chemicals, the wear resistance, durability, and sliding property are ensured by the second gasket 45 made of nitrile rubber, which has less permanent strain caused by compression, to prevent the entry of water, and the heat resistance and weather resistance are ensured by the third gasket 46 made of butyl rubber to prevent the entry of a gas such as water vapor, thereby preventing the fogging of the watch glass 6.

In this case, the plurality of gaskets 44 to 46 are arranged in the order of the first gasket 44, the second gasket 45, and the third gasket 46 from the outer end side to the inner end side of the shaft portion 42 of the first operating member 40. Thus, in the pushbutton switch 5, the entry of liquids such as oil and chemicals is reliably prevented first by the first gasket 44, then, the entry of water is reliably prevented by the second gasket 45, and the entry of a gas such as water vapor is reliably prevented finally by the third gasket 46, thereby preventing the fogging of the watch glass 6. As a result, the high-pressure waterproofness of the pushbutton switch 5 can be achieved efficiently, reliably, and satisfactorily.

Meanwhile, when the switch device 4 is operated to correct the time or the like, first, the lock of the second operating member 51 by the locking unit 52 is released. That is, if the operating head portion 54 is rotated to separate the female screw 52*b* from the male screw 52*a* in a locked state where the male screw 52*a* of the tubular member 50 and the female screw 52*b* of the operating head portion 54 are screwed with each other, the lock by the male screw 52*a* and the female screw 52*b* is released.

Then, the operating head portion 54 is pushed out to the outside of the lower case 17 by the spring force of the second spring member 56, and is turned into the neutral state. At this time, the connecting block 55 does not move and maintains the stationary state, and the connecting block 55 idles with respect to the operating head portion 54 even if the cylinder shaft 54*a* of the operating head portion 54 slides, and thus, the rotation of the operating head portion 54 is not transmitted to the operating shaft 53. Thus, the time or the like is not corrected in this neutral state.

In this neutral state, the operating head portion 54 is further pulled out to the outside of the lower case 17. Then, the cylinder shaft 54*a* slides, the connecting block 55 engages with the cylinder shaft 54*a* inside the cylinder shaft 54*a*, and the connecting block 55 rotates along with the rotation of the operating head portion 54. When the operating head portion 54 is rotated in this state, the operating shaft 53 is rotated by the connecting block 55 to operate the watch movement 12 inside the watch module 7. As a result, the time or the like is corrected.

In addition, when the operating head portion 54 receives the impact from the outside in the state where the operating head portion 54 is pushed and the operating head portion 54 is locked to the tubular member 50 by the locking unit 52 in this switch device 4, the lower case 17 receives the impact via the tubular member 50, and the inner peripheral portion of the lower case 17 is pressed against the impact receiving portion 57 provided on the upper case 18 made of metal.

Thus, the impact is received by the impact receiving portion 57 even if the operating head portion 54 receives the impact from the outside. As a result, the operating shaft 53 of the second operating member 51 is not pushed into the watch module 7 by the impact, and thus, the watch module 7 can be prevented from being damaged by the operating shaft 53 even if the operating head portion 54 of the second operating member 51 receives the impact from the outside.

In this case, the impact receiving portion 57 is provided on the lower surface of the upper case 18 corresponding to the second operating member 51, and abuts on the inner peripheral portion of the lower case 17 in the axial direction of the operating shaft 53, so that the axial deformation of the operating shaft 53 in the lower case 17, which is less rigid than the upper case 18, due to the impact received by the operating head portion 54 is suppressed. Thus, the operating shaft 53 is not pushed into the watch module 7 by the impact.

In addition, the outer peripheral surface of the lower case 17 is provided so as to protrude outward from the outer peripheral surface of the upper case 18, and the lower case 17 receives the impact when the operating head portion 54 receives the impact, so that the impact received by the lower case 17 is reliably and satisfactorily received by the impact receiving portion 57 of the upper case 18.

In addition, in this case, the tubular member 50 into which the operating shaft 53 of the second operating member 51 is slidably inserted is arranged in the second through hole 48 of the lower case 17, and the tubular member 50 holds the second operating member 51 reliably and satisfactorily even if the lower case 17 has lower rigidity than the upper case 18. Thus, the operability of the second operating member 51 is ensured.

In this manner, according to the pushbutton switch 5 of this wristwatch, the lower case 17 provided with the first through hole 39, the first operating member 40 including the shaft portion 42 slidably inserted into the first through hole 39 and the head portion 43 provided at the outer end of the shaft portion 42, and the first to third gaskets 44 to 46, which are provided on the outer periphery of the shaft portion 42 and are in slidable contact with the inner surface of the first through hole 39, are provided, and at least the first gasket 44 among the first to third gaskets 44 to 46 is made of a material having heat resistance and chemical resistance. Thus, the high-pressure waterproofness can be achieved.

That is, the first gasket 44 can ensure the heat resistance and chemical resistance since at least the first gasket 44 is made of the material having the heat resistance and chemical resistance among the first to third gaskets 44 to 46 in the pushbutton switch 5 of this wristwatch. Thus, it is possible to reliably prevent the entry of liquids such as oil and chemicals, and as a result, it is possible to achieve the high-pressure waterproofness.

In this case, the lower case 17 is made of the synthetic resin in the pushbutton switch 5 of this wristwatch, and thus, the manufacturing work is easier and the manufacturing cost can be reduced as compared to the case of forming the lower case 17 using metal, and as a result, the price can be reduced. Further, the heat resistance and chemical resistance can be ensured by the first gasket 44 even if the lower case 17 is made of the synthetic resin, and thus, the entry of liquids such as oil and chemicals can be reliably prevented, which makes it possible to achieve the high-pressure waterproofness.

In addition, in the pushbutton switch 5 of this wristwatch, among the first to third gaskets 44 to 46, the first gasket 44 is made of the material having the heat resistance and chemical resistance, and the second gasket 45 is made of the material that has the wear resistance, durability, less permanent strain caused by compression, and excellent sliding property. Thus, it is possible to further achieve the high-pressure waterproofness.

That is, in this pushbutton switch 5, it is possible to reliably prevent the entry of liquids such as oil and chemicals since the heat resistance and chemical resistance can be ensured by the first gasket 44, and further, it is possible to reliably prevent the entry of water by ensuring the wear resistance, durability, and sliding property with the second gasket 45 which has less permanent strain caused by compression. As a result, the high-pressure waterproofness can be ensured.

In addition, in the pushbutton switch 5 of this wristwatch, among the first to third gaskets 44 to 46, the first gasket 44 is made of the material having the heat resistance and chemical resistance, and the third gasket 46 is made of the material having the heat resistance and weather resistance. Thus, it is possible to further achieve the high-pressure waterproofness.

That is, in this pushbutton switch 5, it is possible to reliably prevent the entry of liquids such as oil and chemicals since the heat resistance and chemical resistance can be ensured by the first gasket 44, and further, it is possible to reliably prevent the entry of the gas such as water vapor and prevent the fogging of the watch glass 6 since the heat resistance and weather resistance can be ensured by the third gasket 46. As a result, the high-pressure waterproofness can be ensured.

Further, in the pushbutton switch 5 of this wristwatch, among the first to third gaskets 44 to 46, the first gasket 44 is made of the material having the heat resistance and chemical resistance, the second gasket 45 is made of the material that has the wear resistance, durability, the less permanent strain caused by compression, and excellent sliding property, and the third gasket 46 is made of the material having the heat resistance and weather resistance. Thus, it is possible to further achieve the high-pressure waterproofness.

That is, in this pushbutton switch 5, it is possible to reliably prevent the entry of liquids such as oil and chemicals since the heat resistance and chemical resistance can be ensured by the first gasket 44, it is possible to reliably prevent the entry of water by ensuring the wear resistance, durability, and sliding property with the second gasket 45, which has less permanent strain caused by compression, and further, it is possible to reliably prevent the entry of the gas such as water vapor and prevent the fogging of the watch glass 6 since the heat resistance and weather resistance can be ensured by the third gasket 46. As a result, it is possible to further ensure the high-pressure waterproofness.

In addition, in the pushbutton switch 5 of this wristwatch, the first to third gaskets 44 to 46 are arranged in the order of the first gasket 44, the second gasket 45, and the third gasket 46 from the outer end side to the inner end side of the shaft portion 42 of the first operating member 40. Thus, the high-pressure waterproofness can be achieved efficiently and satisfactorily.

That is, in this pushbutton switch 5, the high-pressure waterproofness can be achieved efficiently, reliably, and satisfactorily since the fogging of the watch glass 6 can be prevented by reliably preventing the entry of liquids such as oil and chemicals first by the first gasket 44, then, reliably preventing the entry of water by the second gasket 45, and reliably preventing the entry of the gas such as water vapor finally by the third gasket 46.

Further, in the pushbutton switch 5 of this wristwatch, the material of the first gasket 44 is fluorine rubber, the material of the second gasket 45 is nitrile rubber, and the material of the third gasket 46 is butyl rubber. Thus, the high-pressure waterproofness can be reliably and satisfactorily realized. That is, the heat resistance and chemical resistance can be ensured since the first gasket 44 is made of fluorine rubber in this pushbutton switch 5, and thus, it is possible to reliably prevent the entry of liquids such as oil and chemicals.

In addition, in this pushbutton switch 5, there is little permanent strain caused by compression, and the wear resistance, durability, and sliding property can be ensured to prevent the entry of water since the second gasket 45 is made of nitrile rubber. Further, the heat resistance and weather resistance can be ensured since the third gasket 46 is made of butyl rubber, and thus, it is possible to reliably prevent the entry of the gas such as water vapor and prevent the fogging of the watch glass 6.

Note that the above-described embodiment has been described regarding the case where the body connecting hole 17*c* linearly passes through the attachment protruding portions 17*a* on the 6 o'clock side and the 12 o'clock side of the lower case 17 in the tangential direction with respect to the outer periphery of the case body 15, but the invention is not limited thereto, and the body connecting hole 17*c* may pass through the attachment protruding portion 17*a* to be curved along the outer periphery of the case body 15, for example. In this case, it is preferable to make the pin member 33 curved with the same curvature as the body connecting hole 17*c*, and further, it is preferable to make the first to fourth connecting holes 26*b*, 27*b*, 35*b*, and 38*b* of the first to fourth cover portions in the first to third exterior pieces 22 to 24 similarly curved.

In addition, the above-described embodiment has been described regarding the case where the attachment protruding portions 17*a* of the band attachment portion 3 are provided on the 6 o'clock side and the 12 o'clock side of the lower case 17, the body connecting hole 17*c* is provided through the attachment protruding portion 17*a* in the tangential direction with respect to the outer periphery of the case body 15, and the pin member 33 is inserted into the body connecting hole 17*c* to protrude on both sides of the attachment protruding portion 17*a*, but the invention is not limited thereto. For example, body connecting holes are provided on both sides of each of the attachment protruding portions 17*a* in a non-penetrating state, and the first to third exterior pieces 22 to 24 may be individually connected to the respective attachment protruding portions 17*a* of the lower case 17 by pin members inserted into these body connecting holes.

That is, in such a modification, the body connecting holes may be provided on both sides of the attachment protruding portion 17*a*, the pin members may be provided so as to protrude from each of these body connecting holes, and these protruding pin members may be individually inserted into the first connecting holes 26*b* and 27*b* of the first and second cover portions 26 and 27 of the first exterior piece 22 of the first exterior member 20 to be connected and fixed, and individually inserted into the third connecting hole 35*b* of the third cover portion 35 of the second exterior piece 23 and the fourth connecting hole 38*b* of the fourth cover portion 38 of the third exterior piece 24 to be connected and fixed.

In addition, the above-described embodiment has been described regarding the case where the first to third gaskets 44 to 46 are provided on the outer periphery of the shaft portion 42 of the first operating member 40 of the pushbutton switch 5, but the invention is not limited thereto. For example, a structure may be formed in which the first gasket 44 made of a material having heat resistance and chemical resistance and the second gasket 45 made of a material having wear resistance, durability, less permanent strain caused by compression, and an excellent sliding property are provided.

In addition, the invention is not limited thereto, and a structure may be formed in which, for example, the first gasket 44 made of a material having heat resistance and chemical resistance and the third gasket 46 made of a material having heat resistance and weather resistance are provided.

In addition, the invention is not limited thereto, and it is preferable that the first gasket 44 be made of a material having at least chemical resistance and the third gasket 46 be made of a material having at least weather resistance.

Further, the first gasket 44, the second gasket 45, and the third gasket 46 are arranged in this order on the shaft portion 42 of the first operating member 40 from the outer end side to the inner end side in the above-described embodiment, but the invention is not limited thereto, and the gaskets may be arranged in any order.

In addition, the above-described embodiment has been described regarding the case of being applied to the wristwatch, but the invention is not necessarily applied to the wristwatch, and can be applied to various clocks, for example, a travel watch, an alarm clock, a table clock, a wall clock, and the like. In addition, the invention is not necessarily applied to the watch, and can be applied to electronic devices, for example, a mobile terminal, a mobile communication device, and the like.

Although one embodiment of the invention has been described as above, the invention is not limited thereto, and includes inventions described in the claims and the equivalent range thereof.

What is claimed is:

1. A switch device comprising:

a case provided with a through hole;

an operating member having a shaft portion slidably inserted into the through hole; and a plurality of gaskets which are provided on an outer periphery of the shaft portion and are in slidable contact with an inner surface of the through hole, wherein, among the plurality of gaskets, a first gasket is made of a material containing fluorine, and a second gasket is made of a material containing nitrile rubber, and wherein the first gasket and the second gasket are arranged in this order from a first end of the shaft portion provided at an outer peripheral side of the case to a second end of the shaft portion provided at an inner peripheral side of the case.

2. The switch device according to claim 1, wherein the case is made of a synthetic resin.

3. The switch device according to claim 1, wherein, among the plurality of gaskets, the first gasket is made of the material containing fluorine, the second gasket is made of the material containing nitrile rubber, and a third gasket is made of a material containing butyl rubber.

4. The switch device according to claim 2, wherein, among the plurality of gaskets, the first gasket is made of the material containing fluorine, the second gasket is made of the material containing nitrile rubber, and a third gasket is made of a material containing butyl rubber.

5. The switch device according to claim 3, wherein the plurality of gaskets are arranged in an order of the first gasket, the second gasket, and the third gasket from the first end to the second end.

6. The switch device according to claim 4, wherein the plurality of gaskets are arranged in an order of the first gasket, the second gasket, and the third gasket from the first end to the second end.

7. The switch device according to claim 3, wherein the plurality of gaskets are arranged in an order of the third gasket, the first gasket, and the second gasket from the first end to the second end.

8. The switch device according to claim 4, wherein the plurality of gaskets are arranged in an order of the third gasket, the first gasket, and the second gasket from the first end to the second end.

9. A timepiece comprising the switch device according to claim 1.

* * * * *